US009310758B2

(12) United States Patent
Oba et al.

(10) Patent No.: US 9,310,758 B2
(45) Date of Patent: Apr. 12, 2016

(54) IMAGE FORMING APPARATUS

(71) Applicant: CANON KABUSHIKI KAISHA, Tokyo (JP)

(72) Inventors: Katsuhiko Oba, Odawara (JP); Masahiro Tambo, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/624,685

(22) Filed: Feb. 18, 2015

(65) Prior Publication Data

US 2015/0234344 A1 Aug. 20, 2015

(30) Foreign Application Priority Data

Feb. 17, 2014 (JP) ..... 2014-027557

(51) Int. Cl.
*G03G 15/00* (2006.01)
*G03G 21/16* (2006.01)
*G03G 21/18* (2006.01)

(52) U.S. Cl.
CPC ..... *G03G 21/168* (2013.01); *G03G 15/657* (2013.01); *G03G 21/1647* (2013.01); *G03G 21/181* (2013.01); *G03G 21/1821* (2013.01); *G03G 21/1828* (2013.01); *G03G 2215/0154* (2013.01); *G03G 2215/0875* (2013.01); *G03G 2221/1609* (2013.01); *G03G 2221/1807* (2013.01)

(58) Field of Classification Search
CPC ..... G03G 21/168; G03G 21/181; G03G 21/1821; G03G 21/1828; G03G 2215/0154; G03G 2215/0875; G03G 2221/1609; G03G 2221/1807
See application file for complete search history.

(56) References Cited

U.S. PATENT DOCUMENTS

| | | | | |
|---|---|---|---|---|
| 4,583,832 | A * | 4/1986 | Kasamura et al. | 399/119 |
| 6,075,956 | A * | 6/2000 | Watanabe et al. | 399/92 |
| 6,091,916 | A * | 7/2000 | Dycher | 399/114 |
| 6,681,089 | B2 * | 1/2004 | Dougherty | 399/111 |
| 2004/0126134 | A1 * | 7/2004 | Harada et al. | 399/114 |
| 2006/0072937 | A1 * | 4/2006 | Hymas et al. | 399/111 |
| 2010/0054797 | A1 * | 3/2010 | Takeyama et al. | 399/111 |
| 2010/0129101 | A1 * | 5/2010 | Muto | 399/53 |
| 2012/0039625 | A1 * | 2/2012 | Sekido et al. | 399/110 |
| 2013/0195505 | A1 * | 8/2013 | Hashimoto et al. | 399/110 |

FOREIGN PATENT DOCUMENTS

| | | | |
|---|---|---|---|
| JP | 04-296886 | A | 10/1992 |
| JP | 11-184351 | A | 7/1999 |

* cited by examiner

*Primary Examiner* — Ryan Walsh
(74) *Attorney, Agent, or Firm* — Fitzpatrick, Cella, Harper & Scinto

(57) ABSTRACT

An image forming apparatus in which a cartridge including an image bearing member is detachably mountable to a main assembly thereof includes a cartridge mounting portion, a transfer device contactable to the image bearing member, a feeding mechanism, and a guiding member. The guiding member is movable between a first position where the image bearing member and the transfer device are spaced from each other when the cartridge is in the cartridge mounting portion and a second position where when the cartridge is in the cartridge mounting portion, the image bearing member and the transfer device are permitted to contact each other and the recording material is guided toward the downstream side with respect to the feeding direction. When the guiding member is in the first position, the guiding member is positioned between the transfer device and the cartridge and covers the transfer device.

10 Claims, 15 Drawing Sheets

IMAGE FORMING APPARATUS

FIELD OF THE INVENTION AND RELATED ART

The present invention relates to an image forming apparatus, such as a copying machine, a printer or a facsimile machine, of an electrophotographic type.

A conventional image forming apparatus of the electrophotographic type employs a process cartridge type in which a photosensitive drum as an image bearing member and a process means actable on the photosensitive drum are integrally assembled into a cartridge (unit) which is detachably mountable to the image forming apparatus.

In recent years, when the image forming apparatus is transported, a cartridge-packed transportation form, in which a process cartridge is packed in an apparatus main assembly of the image forming apparatus, is used for the purpose of enhancing transportation efficiency increases.

In this case, when the image forming apparatus is transported while the photosensitive drum in a cartridge side and a transfer roller in an apparatus main assembly side are contacted to each other, a recessed portion is formed on the transfer roller, so that an image defect generates. For that reason, a constitution in which the image forming apparatus is transported in a state in which the photosensitive drum and the transfer roller are spaced using an exclusive member for spacing the photosensitive drum and the transfer roller from each other is employed in many cases.

Japanese Laid-Open Patent Application (JP-A) Hei 11-184351 discloses a constitution in which a switching member for determining a position of a drum protecting member is provided on a process cartridge, and a transportation form in which the photosensitive drum and the transfer roller are spaced from each other and a use (operation) form which is the form during a printing operation are switched therebetween.

In the constitution of JP-A Hei 11-184351, when a user first uses the image forming apparatus, there was a need to switch the switching member for the process cartridge from the transportation form to the use form. For this reason, there was a possibility that the user forgets about switching the switching member to the position of the use form and thus erroneously inserts the process cartridge while being kept in the transportation form.

Further, in the case where the photosensitive drum and the transfer roller are spaced from each other using the exclusive spacing member, there was a need to demount the spacing member before use of the image forming apparatus.

Therefore, an image forming apparatus which is simplified and further excellent in operativity has been required.

SUMMARY OF THE INVENTION

According to an aspect of the present invention, there is provided an image forming apparatus for forming an image on a recording material, wherein a cartridge including at least an image bearing member on which a toner image is to be formed is detachably mountable to a main assembly of the image forming apparatus, the image forming apparatus comprising: a cartridge mounting portion for detachably mounting the cartridge; a transfer device contactable to the image bearing member to form a nip where the toner image is transferred from the image bearing member onto the recording material; a feeding mechanism for feeding the recording material to the nip; and a movable guiding member for guiding the recording material toward a downstream side with respect to a feeding direction of the recording material, wherein the guiding member is movable between a first position where the image bearing member and the transfer device are spaced from each other when the cartridge is in the cartridge mounting portion and a second position where when the cartridge is in the cartridge mounting portion, the image bearing member and the transfer device are permitted to contact each other and the recording material is guided toward the downstream side with respect to the feeding direction, and wherein when the guiding member is in the first position, the guiding member is positioned between the transfer device and the cartridge and covers the transfer device.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings. However, with respect to functions, materials, shapes, relative arrangements and the like of constituent elements described in the following embodiments, the scope of the present invention is not intended to be limited to only the embodiments unless otherwise specified.

Embodiment 1

General Structure of Image Forming Apparatus

Figure 7:
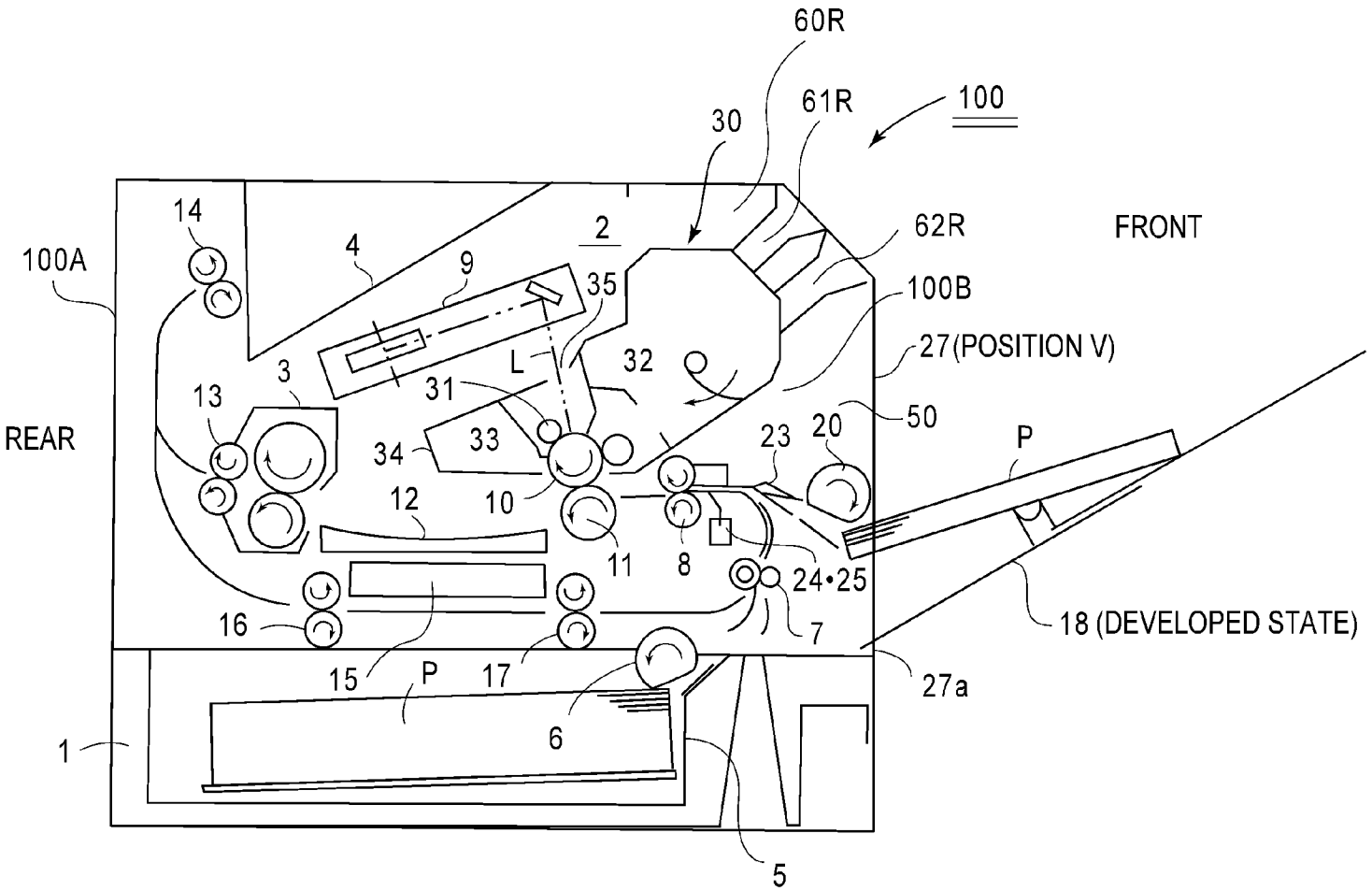
FIG. 7 is a schematic longitudinal left side view of the image forming apparatus in Embodiment 1.

FIG. 7 is a schematic longitudinal left side view of an image forming apparatus 100 of a process cartridge type in this embodiment. This image forming apparatus 100 is an electrophotographic laser beam printer (electrophotographic image forming apparatus) in which a process cartridge 30 is detachably mounted in (mountable to) a cartridge mounting portion 100B of an image forming apparatus main assembly 100A and then is used.

Figure 13:
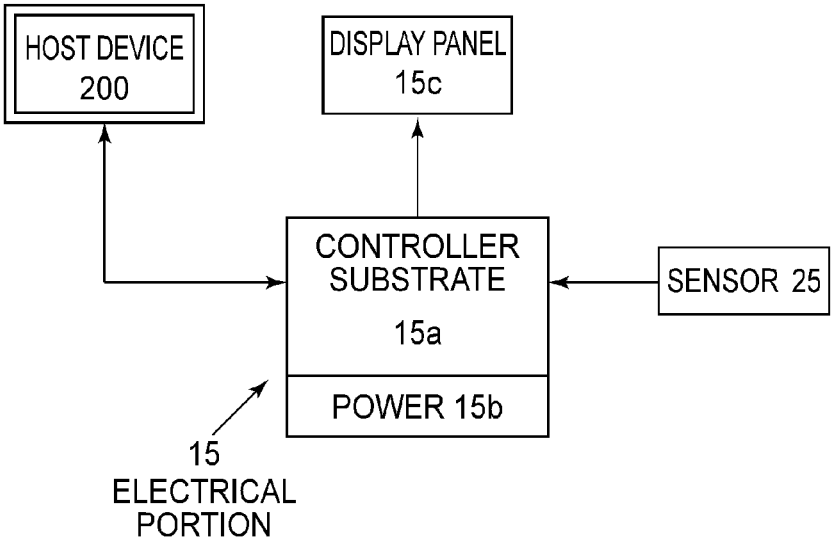
FIG. 13 is a block diagram of a control system.

That is, referring to FIG. 13, a toner image corresponding to electrical image information inputted from an external host device 200 such as a personal computer, an image reader or a facsimile machine into a controller substrate (control circuit portion) 15*a* can be formed and printed out on a recording material P. An electrical portion 15 includes a power source portion 15*b* for the image forming apparatus 100 and the controller substrate 15*a* for controlling the image forming apparatus 100. The recording material P is a sheet member on which the toner image is to be formed, and examples thereof may include regular-sized or irregular-sized sheets such as plain paper, thick paper, an envelope, a post card, a seal, a resinous sheet, an OHP sheet and glossy paper.

In the following description, a front (surface) side of the image forming apparatus 100 is a side where an openable door (cartridge cover) 27 is provided. A rear (surface) side is an opposite side from the front side. Left and right are those when the image forming apparatus 100 is seen from the front side. Upper and lower are those with respect to a direction of gravitation. Further, a rotational axis direction of an electrophotographic photosensitive drum 10 as an image bearing member is a longitudinal direction. Further, with respect to the longitudinal direction, a side (right side in this embodiment) where the photosensitive drum 10 receives a driving force from the apparatus main assembly 100A is a driving side, and an opposite side from the driving side is a non-driving side.

A schematic structure of the image forming apparatus 100 shown in FIG. 7 will be described along a flow of the recording material (medium) P. The recording material P is fed to an image forming means 2 by a sheet supplying mechanism 1 and onto which the toner image is transferred, and thereafter the recording material P is fed to a fixing device (fixing means) 3. The toner image is fixed on the recording material P by the fixing device 3, and then the recording material P is discharged onto a discharge portion 4.

Specifically, a cassette 5 constituting a part of the supplying mechanism 1 is mounted at a lower portion of the image forming apparatus 100. In the cassette 5, the recording material P is stacked and accommodated. The recording material P in the cassette 5 is fed in order from an uppermost recording material P by a feeding roller 6 rotating in a counterclockwise direction, and then is fed to the image forming means 2 by a feeding roller pair 7 and a registration roller pair 8.

The image forming means 2 is constituted by the process cartridge 30 mounted in the cartridge mounting portion 100B of the apparatus main assembly 100A, a laser scanner 9 as an exposure means, a transfer roller 11 as a transfer device, and the like. The cartridge 30 in this embodiment is prepared by integrally assembling the photosensitive drum 10, and as process means actable on the photosensitive drum 10, a charging means 31, a developing means 32 and a cleaning means 33 with a cartridge frame 34 into a user (cartridge).

The charging means 31 is a device for electrically charging an outer peripheral surface of the photosensitive drum 10 uniformly to a predetermined polarity and a predetermined potential and is a charging roller in this embodiment. The developing means 32 is a device for developing an electrostatic latent image, formed on the surface of the photosensitive drum 10, with a developer (toner) into the toner image. The cleaning means 33 is a device for cleaning the photosensitive drum surface by removing a residual matter such as a transfer residual toner from the photosensitive drum surface after the toner image transfer on the recording material P, and is a blade cleaning device in this embodiment.

The surface of the photosensitive drum 10 which is rotationally driven in a clockwise direction at a predetermined peripheral speed (process speed) and which is charged by the charging roller 31 is irradiated with laser light L depending on image information by the laser scanner 9, so that the electrostatic latent image is formed on the photosensitive drum. The irradiation of the photosensitive drum 10 with the laser light L from the laser scanner 9 is made through a window hole 35 formed in a slit shape in an upper surface of the cartridge frame 34. This electrostatic latent image is developed into the toner image by the developing device 32.

To a lower surface of the photosensitive drum 10, the transfer roller 11 is contacted at a predetermined urging force (pressure), and thus a transfer nip is formed. To this transfer nip, the recording material P fed by the supplying mechanism 1 as described above is introduced at predetermined control timing and is nipped and fed, and at the same time, a predetermined transfer bias (voltage) is applied to the transfer roller 11. As a result, in the transfer nip, the toner image is successively transferred from the photosensitive drum 10 onto the surface of the recording material P. In this embodiment, the registration roller pair 8 is a feeding mechanism for feeding the recording material P to the transfer nip.

The recording material P coming out of the transfer nip is successively separated from the surface of the photosensitive drum 10, and is passed through a feeding guide 12 and then is introduced into the fixing device 3, so that the recording material P is nipped and fed at the fixing nip formed between a fixing member and a pressing member. As a result, the (unfixed) toner image on the recording material P is fixed as a fixed image. In the case where a one-side recording mode is selected, the recording material P passed through the fixing nip is fed by a feeding roller pair 13 and a discharging roller pair 14, and then is discharged as a one-side-recorded product onto the discharge portion 4 provided at an upper portion of the image forming apparatus 100. The surface of the photosensitive drum 10 after the separation of the recording material P is cleaned by the cleaning device 33 and then is repetitively subjected to image formation.

In the case where a double-side recording mode is selected, the recording material P on which the image is recorded (formed) in a front (one) surface by being passed through the fixing device 3 is switched back and fed by reversed drive of the discharging feeding roller pair 14. The recording material P is further fed to the feeding roller pair 7 again by feeding roller pairs 16 and 17, and then is introduced into the transfer nip of the image forming means 2 at predetermined control timing by the registration roller pair 8 in a state in which the recording material P is turned upside down. As a result, the toner image transfer onto a back surface (the other surface) of the recording material P is made.

Thereafter, similarly as in the case of the one-side recording mode, the recording material P is fed by the fixing device 3, the feeding roller pair 13 and the discharging feeding roller pair 14, and then is discharged as a double-side-recorded product onto the discharge portion 4.

Figure 8:
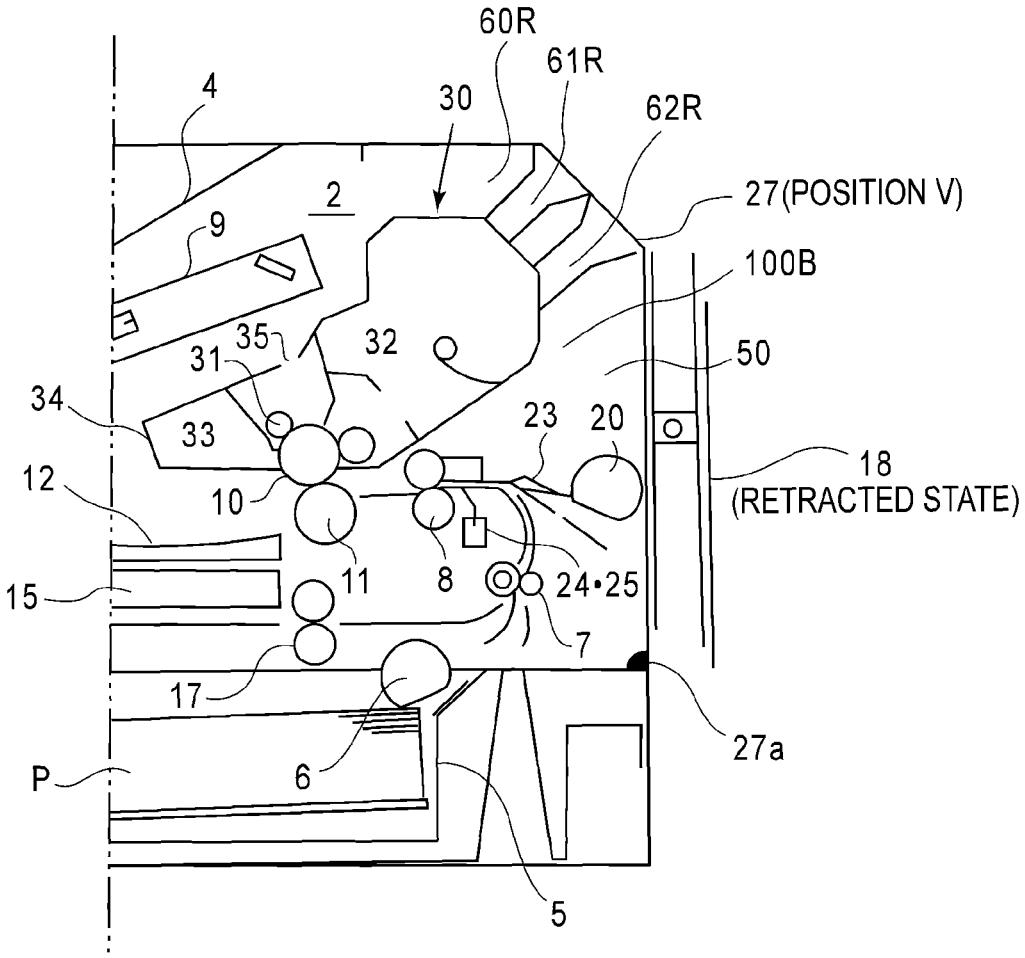
FIG. 8 is a schematic view showing a retracted state of a manual-bypass tray.

The image forming apparatus 100 in this embodiment is provided with the manual-bypass tray 18 as a manually feeding portion is provided outside the openable door 27 provided in the front side. The manual-bypass tray 18 is folded in and retracted relative to the openable door 27 as shown in FIG. 8. In the case where the recording material P is fed using the manual-bypass tray 18, as shown in FIG. 7, the manual-bypass stray 18 is developed from an outer surface toward the front side of the openable door 27 to be placed in a developed state, and then the recording material P is stacked.

The recording material P stacked on the manual-bypass tray 18 is fed in order from an uppermost recording material P by a manual-feeding roller 20 rotating in the clockwise direction, and then is fed to the transfer nip of the image forming means at predetermined control timing by the registration roller pair 8. As a result, image formation of the manually fed recording material P is carried out.

In an upstream side of the registration roller pair 8 with respect to a recording material feeding direction, a top sensor flag (detection flag) 24 and a photo-sensor (detecting sensor) 25 which are provided near the registration roller pair 8 are disposed.

The flag 24 and the sensor 25 detect a leading end (edge) of the recording material P, in the front side of the registration roller pair 8, fed to the registration roller pair 8 from the cassette 5 side, the manual-bypass tray 18 side or the feeding roller pair 17 side. The controller substrate 15*a* controls image writing timing on the photosensitive drum 1 on the basis of a detection signal. That is, the flag 24 and the sensor 25 detect the leading end of the recording material P, and the controller substrate 15*a* controls the image writing timing during a printing operation of the image forming apparatus 100.

Figure 9:
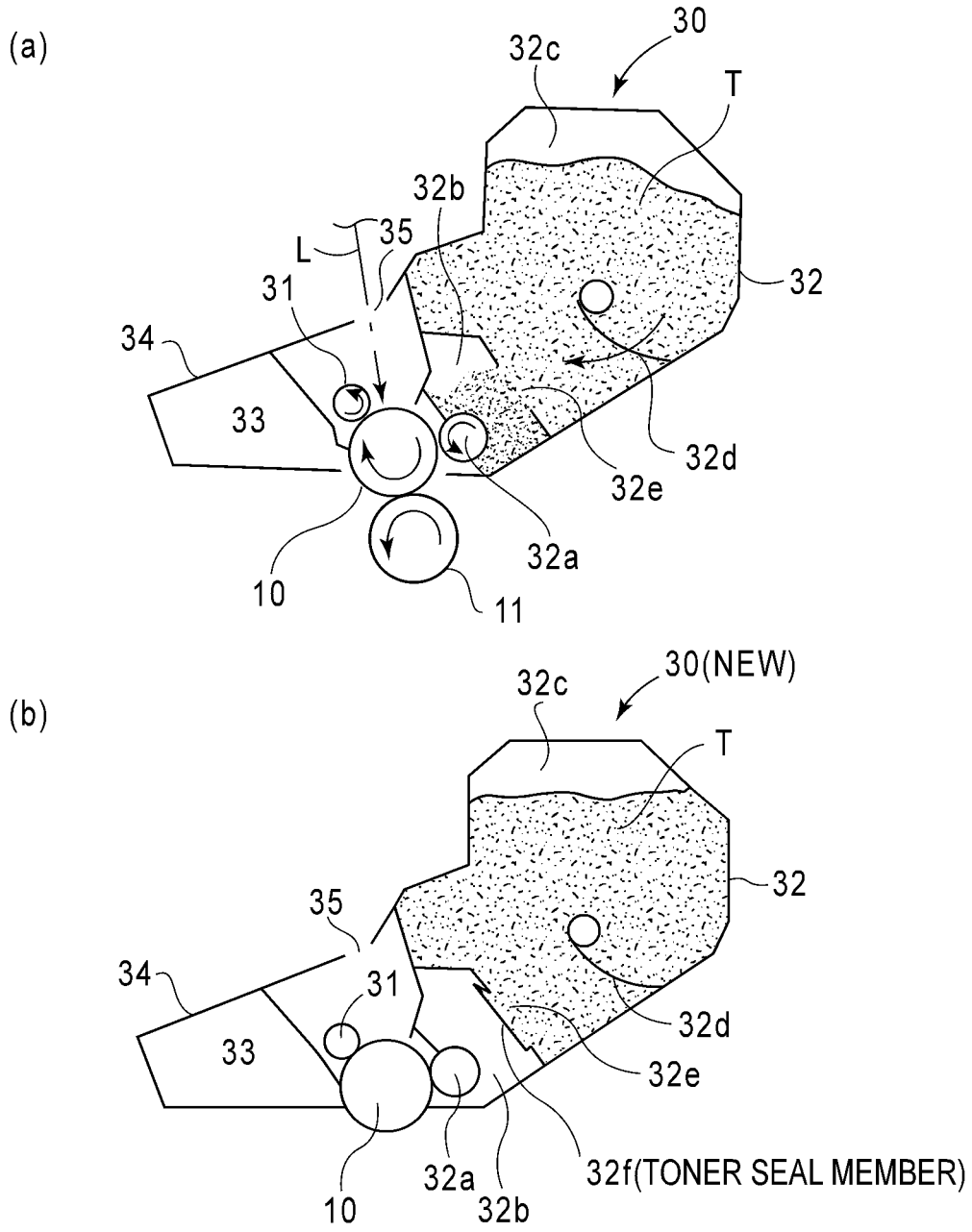
In FIG. 9, (*a*) and (*b*) are illustrations of a process cartridge.

In FIG. 9, (*a*) is an enlarged view of the cartridge 30 portion shown in FIG. 7. The developing device 32 includes a developing chamber 32*b* having a developing roller 32*a* as a toner carrying and feeding member for supplying a toner T to the photosensitive drum 10, and includes a toner chamber 32*c* accommodating the toner T to be supplied to the developing chamber 32*b*. The toner T in the toner chamber 32*c* is replenished toward the developing chamber 32*b* through a communication opening 32*e* between the toner chamber 32*c* and the developing chamber 32*b*, and then is supplied to the developing roller 32*a*.

The cartridge 30 which is not used and is new is closed at the communication opening 32*e* by a toner seal member 32*f* as shown in (*b*) of FIG. 9, and thus no toner T exists in the developing chamber 32*b*, so that movement of the toner T from the toner chamber 32*c* to the developing chamber 32*b* is prevented. As a result, leakage-out of the toner T from the developing device 32 during transportation of the cartridge 30 and the image forming apparatus 100 in which the cartridge 30 is packed is prevented. When the cartridge 30 is used, the toner seal member 32*f* is unsealed (removed), so that the toner T is moved from the toner chamber 32*c* to the developing chamber 32*b* through the communication 32*e*.

Figure 12:
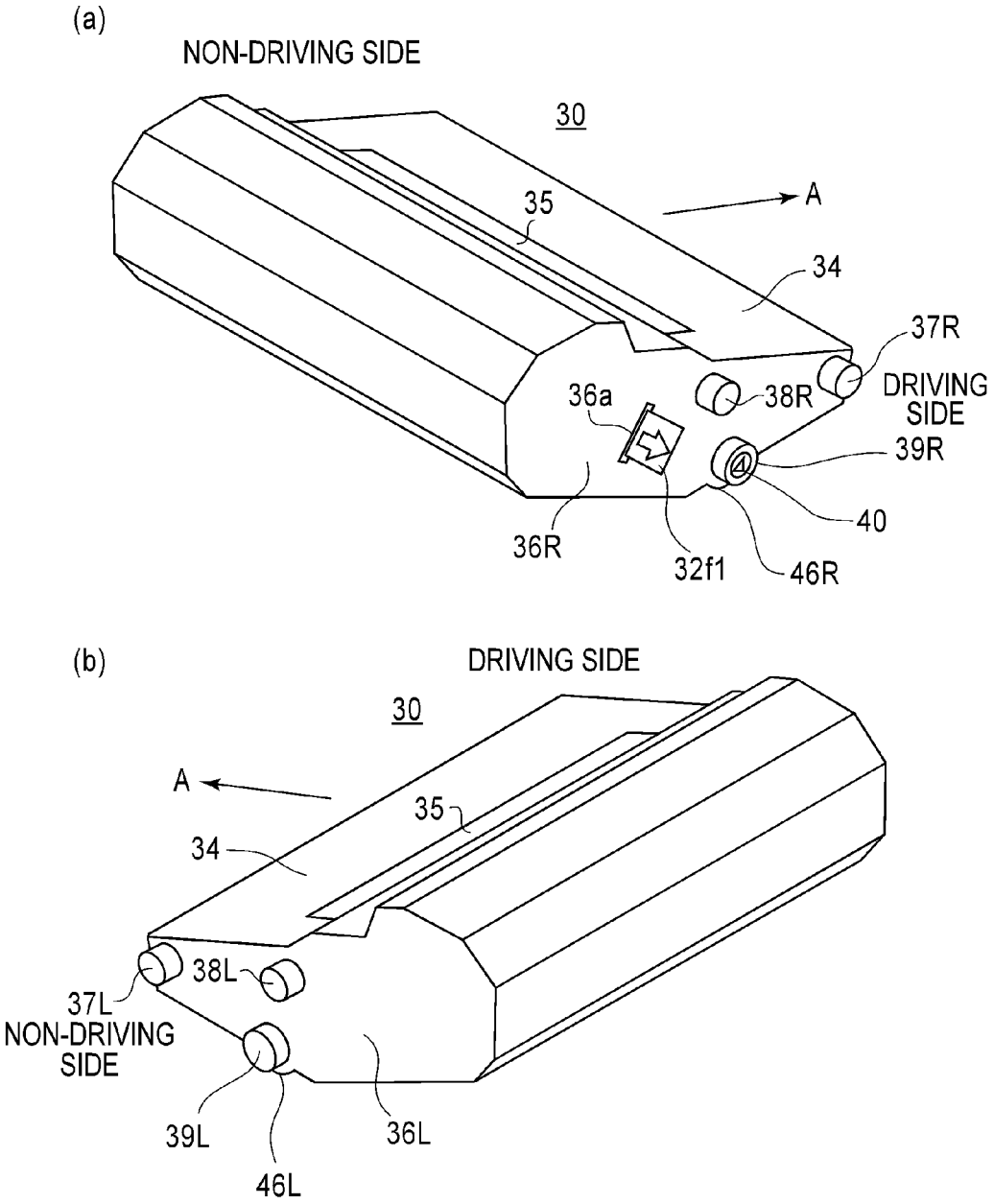
In FIG. 12, (*a*) and (*b*) are perspective views of an outer appearance of the process cartridge.

The unsealing of the toner seal member 32*f* is made, as shown in (*a*) of FIG. 12, by a user in a manner such that the user pinches and pulls a toner seal member end portion 32*f*1, with fingers, exposed to the outside through a slit (hole) 36*a* provided in a side surface 36R of the frame 34 of the cartridge 30 in a driving side. That is, the toner seal member 32*f* is pulled out and removed to the outside of the cartridge 30 from the communication 32*e* by pulling the end portion 32*f*1 thereof, so that the communication opening 32*e* is unsealed or exposed (i.e., removal of the toner seal member 32*f* from the communication opening 32*e*).

(Cartridge Exchanging Method)

In the cartridge 30, with use of the cartridge 30 for the image formation, the toner accommodated in the developing device 32 is consumed. When the toner is consumed to the extent such that the image forming apparatus cannot form an image of a satisfactory quality by the user who purchased the cartridge 30, the cartridge 30 losses commercial value as the cartridge.

Therefore, e.g., a means (not shown) for detecting a remaining developer amount of the cartridge 30 is provided. Further, the controller substrate 15*a* compares a detected remaining amount value with a threshold set in advance for prewarning or warning of an end of a lifetime of the cartridge 30. When the detected remaining amount value is smaller than the threshold, prewarning or warning of the end of the lifetime of the cartridge used is displayed on a display panel 15*c* (FIG. 13) provided on the image forming apparatus 100. As a result, the image forming apparatus 100 prompts the user to prepare a cartridge for exchange or to replace the cartridge used with a new cartridge, so that a quality of an output image is maintained.

Figure 10:
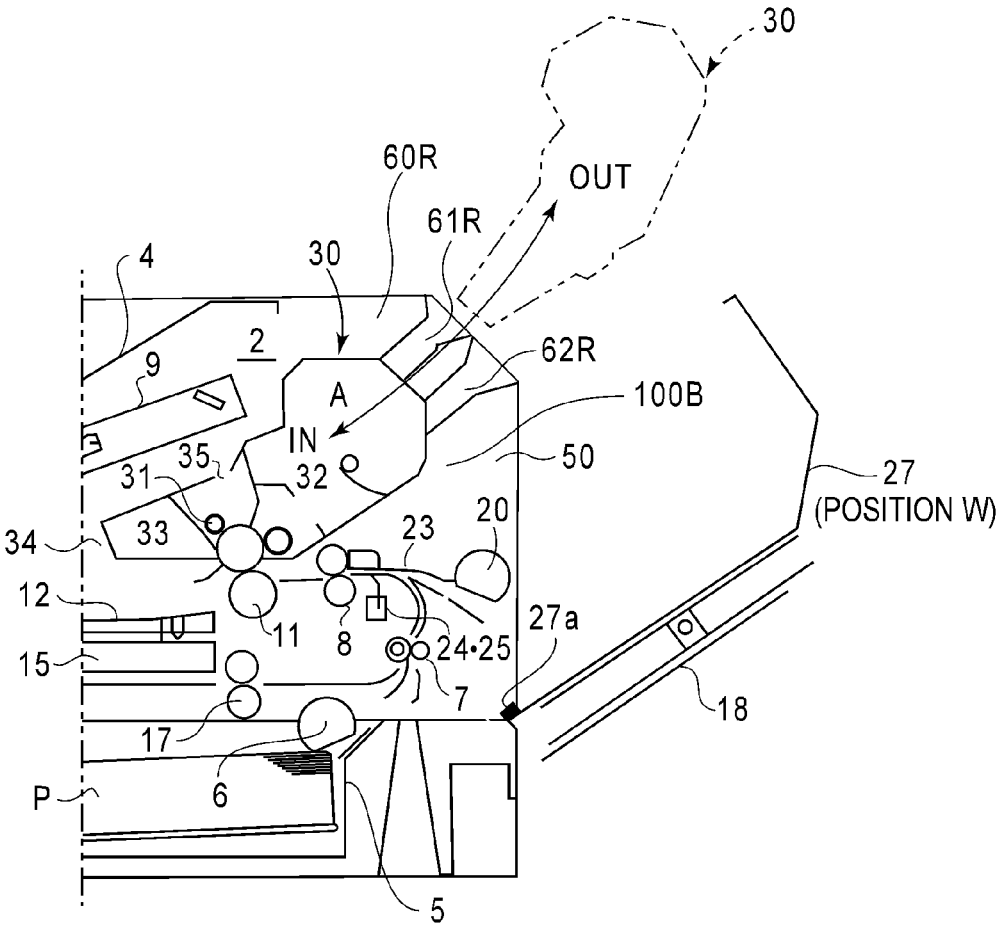
FIG. 10 is a schematic view for illustrating a mounting and demounting manner of the process cartridge.

In the image forming apparatus 100 in this embodiment, the exchange (replacement) of the cartridge 30 is made in a front-access manner by opening the openable door 27 in the front side of the image forming apparatus 100. The apparatus main assembly 100A has an opening 50, in the front side through which the cartridge 30 is inserted in and taken out. The openable door 27 is rotatable about a lower-side hinge portion 27*a* so that the openable door 27 is movable between a closed position V where the opening 50 is closed and an open position W where the opening 50 is open as shown in FIG. 10 by rotation of the openable door 27 from the closed position V toward the front side of the apparatus main assembly 100A. The openable door 27 is opened (rotated) to the open position W, so that the opening 50 is largely opened (exposed) and thus the user has access to the inside of the apparatus main assembly 100A.

Figure 11:
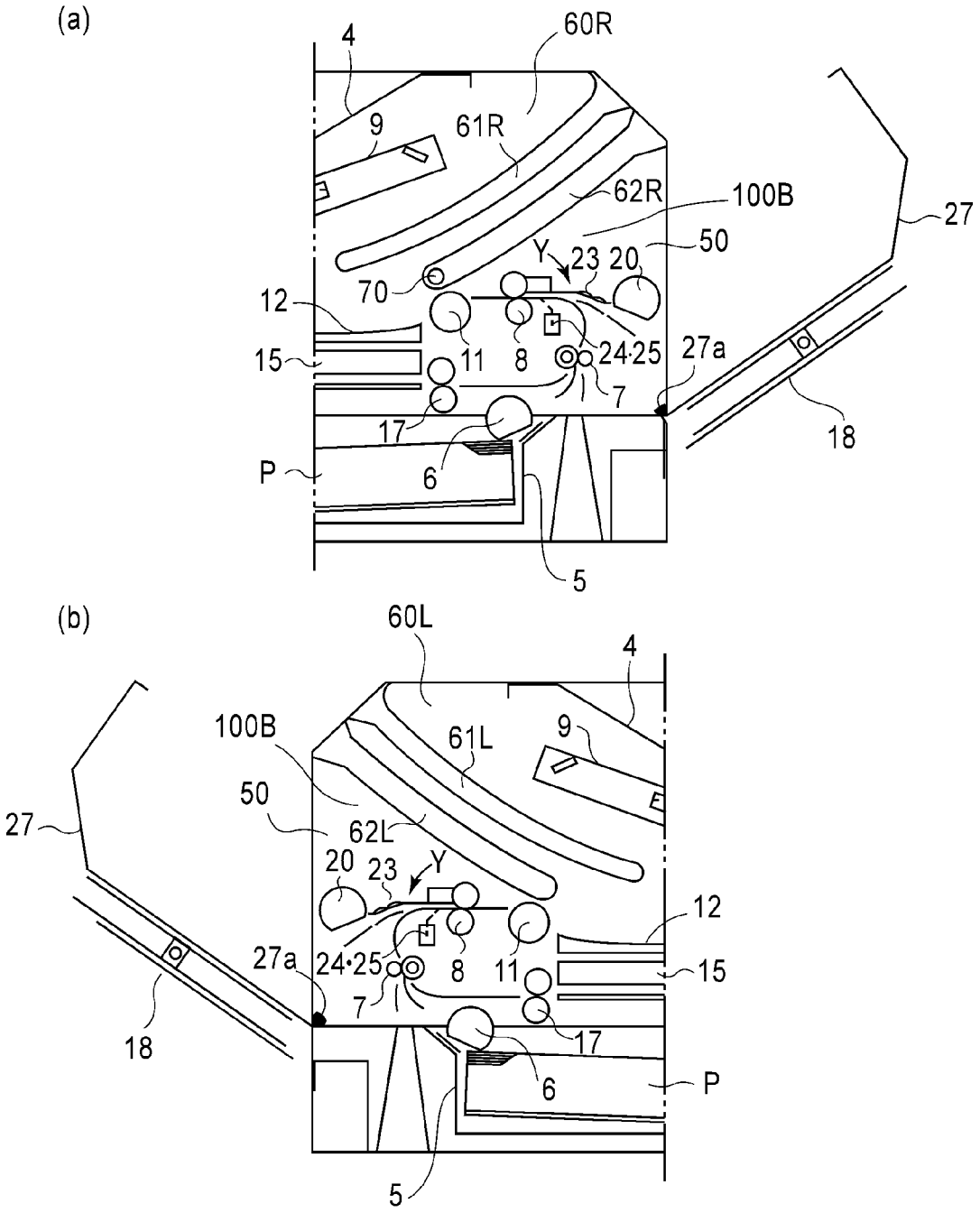
In FIG. 11, (*a*) and (*b*) are schematic views showing an open state of an openable door.

As shown in (*a*) and (*b*) of FIG. 11, on each of a side surface 60R in the driving side of and a side surface 60L in the non-driving side of the cartridge mounting portion 100B of the apparatus main assembly 100A, upper and lower (two) cartridge mounting and demounting guide grooves 61R and 62R (or 61L and 62L) are provided so that the guide grooves 61R and 62R and the guide grooves 61L and 62L are disposed in a mirror-symmetrical manner.

Figure 2:
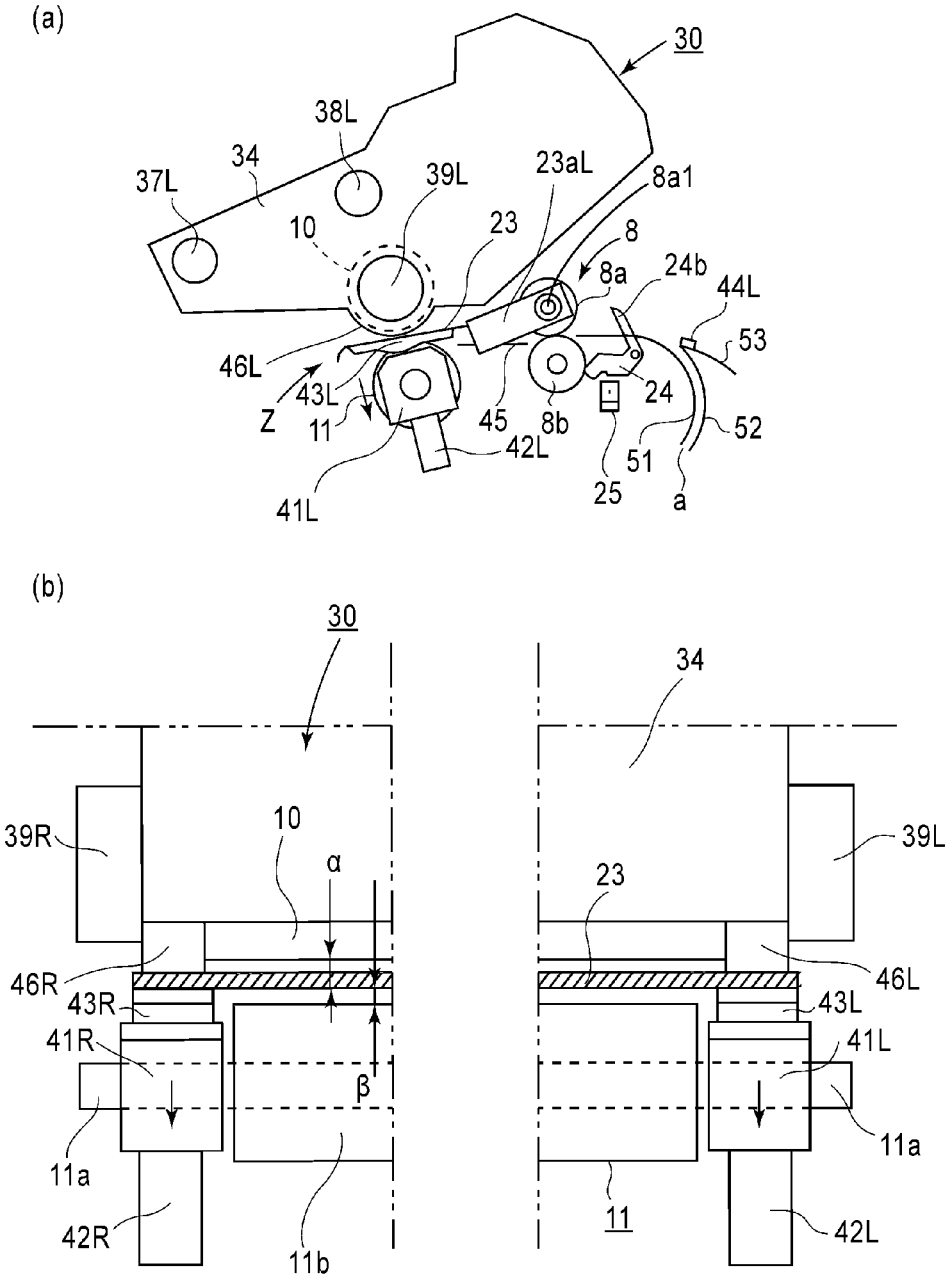
In FIG. 2, (*a*) and (*b*) are schematic views for illustrating motion of the feeding guide plate.

On the other hand, as shown in FIG. 2, on each of a side surface 36R in the driving side of and a side surface 36L in the non-driving side of the frame 34 of the cartridge 30, upper and lower (two) bosses 37R and 38R (or 37L and 38L) and a cylindrical portion 39R (or 39L) are provided so that the bosses 37R and 38R and the cylindrical portion 39R, and the bosses 37L and 38L and the cylindrical portion 39L are disposed in a bilateral-symmetrical manner. The cylindrical portions 39R and 39L are bearing portions in the driving side and the non-driving side, respectively, of the photosensitive drum 10. The cylindrical portion 39R in the driving side is provided with a driving force receiving portion 40. Further, the side surface 36R in the driving side and the side surface in the non-driving side of the frame 34 are provided with downward projected portions 46R and 46L, respectively, formed coaxially with the cylindrical portions 39R and 39L in an arcuate shape having a diameter somewhat larger than a diameter of the photosensitive drum 10.

Mounting of the cartridge 30 in the cartridge mounting portion 100B of the apparatus main assembly 100A is made in the following manner. The openable door 27 is opened, so that the opening 50 of the apparatus main assembly 100A is opened or exposed (FIGS. 10 and 11).

In the case where the cartridge 30 to be inserted is an unused and new cartridge ((*b*) of FIG. 9), in the above-described manner, the toner seal member 32*f* is pulled out and removed, so that the communication opening 32*e* of the developing device 32 is opened or exposed. Further, if a photosensitive drum cover for protecting an exposed surface of the photosensitive drum 10 is mounted in the cartridge 30, the cartridge is demounted and removed.

Further, the cartridge 30 is gradually inserted into the cartridge mounting portion 100B so that the driving side bosses 37R and 38R of the cartridge 30 move along the driving side upper guide groove 61R and so that the non-driving side bosses 37L and 38L of the cartridge 30 move along the non-driving side upper guide groove 61L. In FIG. 12, A represents an inserting direction of the cartridge 30 into the cartridge mounting portion 100B.

Then, the driving side cylindrical portion 39R and the non-driving side cylindrical portion 39L of the cartridge 30 gradually enter the cartridge mounting portion 100B along the driving side lower guide groove 62R and the non-driving side lower guide groove 62L, respectively. Then, when the cylindrical portions 39R and 39L abut against positioning portions as terminal portions of the lower guide grooves 62R and 62L in the driving side and the non-driving side, respectively, the insertion of the cartridge 30 is completed.

Figure 14:
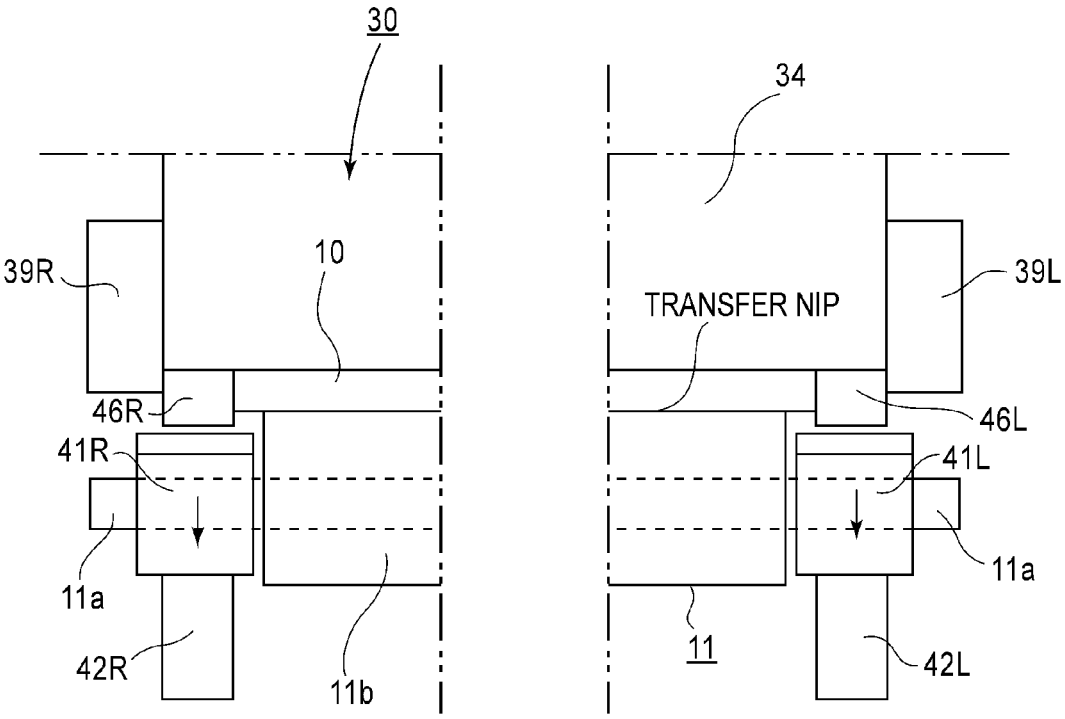
FIG. 14 is a schematic view for illustrating formation of a transfer nip.

In this state, the cartridge 30 is located in an image formable position in the cartridge mounting portion 100B, and is in a state in which the transfer nip is formed by contact of the transfer roller 11 to the lower surface of the photosensitive drum 10 with a predetermined urging force (pressure) as described later (FIG. 14). Further, the driving force receiving portion 40 provided on the driving side cylindrical portion 39 is in a state of opposing a drive (driving force) output portion 70 ((*a*) of FIG. 11) positioned at the terminal portion of the driving side lower guide groove 62R.

Then, the openable door 27 is moved (rotated) from the open position W to the closed position V, so that the opening 50 is closed. An urging mechanism (not shown) performs an urging operation via an interrelating mechanism (not shown) interrelating with the closing operation of the openable door 27, so that the cartridge 30 is positionally fixed in the image formable position in the cartridge mounting portion 100B. Further, the drive output portion 70 projects toward the cartridge mounting portion 100B, and thus is in a state of connection (coupling) with the driving force receiving portion 40 of the cartridge 30. Further, an electrical contact (not shown) of the cartridge 30 and an electrical contact (not shown) of the apparatus main assembly 100A is contacted to each other, and electrical conduction is established. As a result, the image forming apparatus 100 is in a state in which an image forming operation is possible.

Further, on the other hand, the demounting of the cartridge 30 from the cartridge mounting portion 100B of the apparatus main assembly 100A is made in the following manner. The openable door 27 is opened and moved from the closed position V to the open position W. By the interrelating mechanism interrelating with the operation of the openable door 27, the drive output portion 70 is retracted from the cartridge mounting portion 100B, so that the connection thereof with the driving force receiving portion 40 of the cartridge 30 is eliminated. Further, the positional fixing of the cartridge 30 to the apparatus main assembly 100A by the urging mechanism is eliminated. Further, the opening 50 is largely opened, so that a side where the developing device 32 of the cartridge 30 mounted in the cartridge mounting portion 100B is disposed is exposed.

Then, the user holds the developing device 32 side of the cartridge 30 and then pulls out and moves the cartridge 30 in a direction opposite to the inserting direction A. That is, the cartridge 30 is pulled out and moved from the cartridge mounting portion 100B so that the driving side bosses 37R and 38R move along the driving side upper guide groove 61R and so that the non-driving side bosses 37L and 38L move along the non-driving side upper guide groove 61L. As a result, the cartridge 30 is pulled out from the cartridge mounting portion 100B and then is taken out to the outside of the apparatus main assembly 100A.

Figure 3:
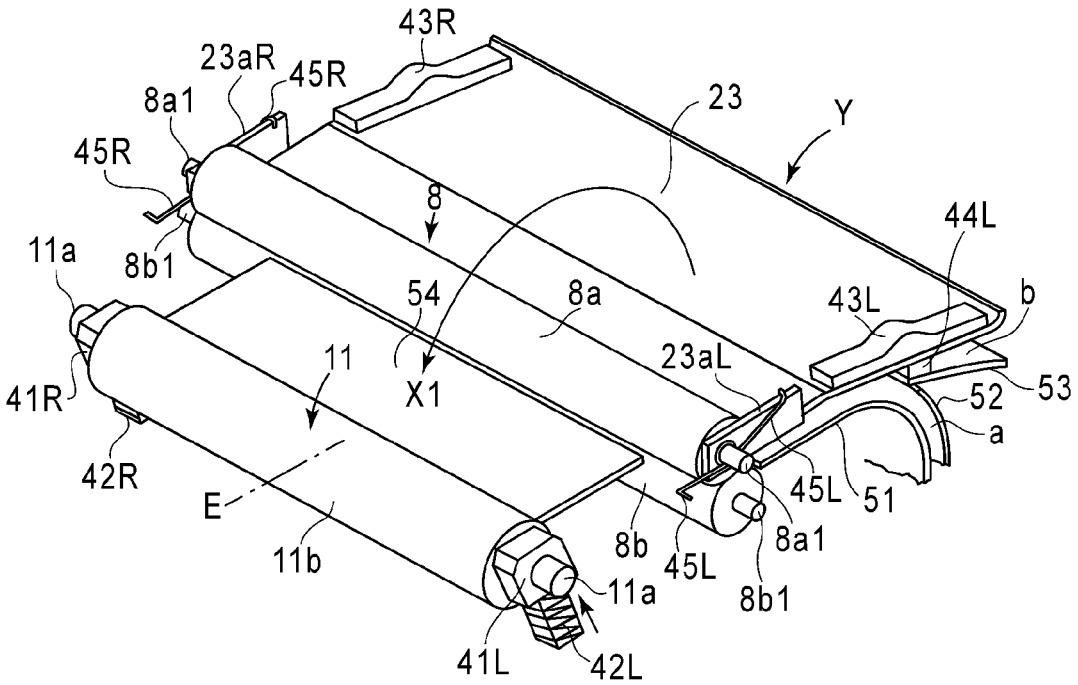
FIG. 3 is a perspective view of a registration roller pair and a transfer roller in an image forming apparatus shown in FIG. 7.
Figure 4:
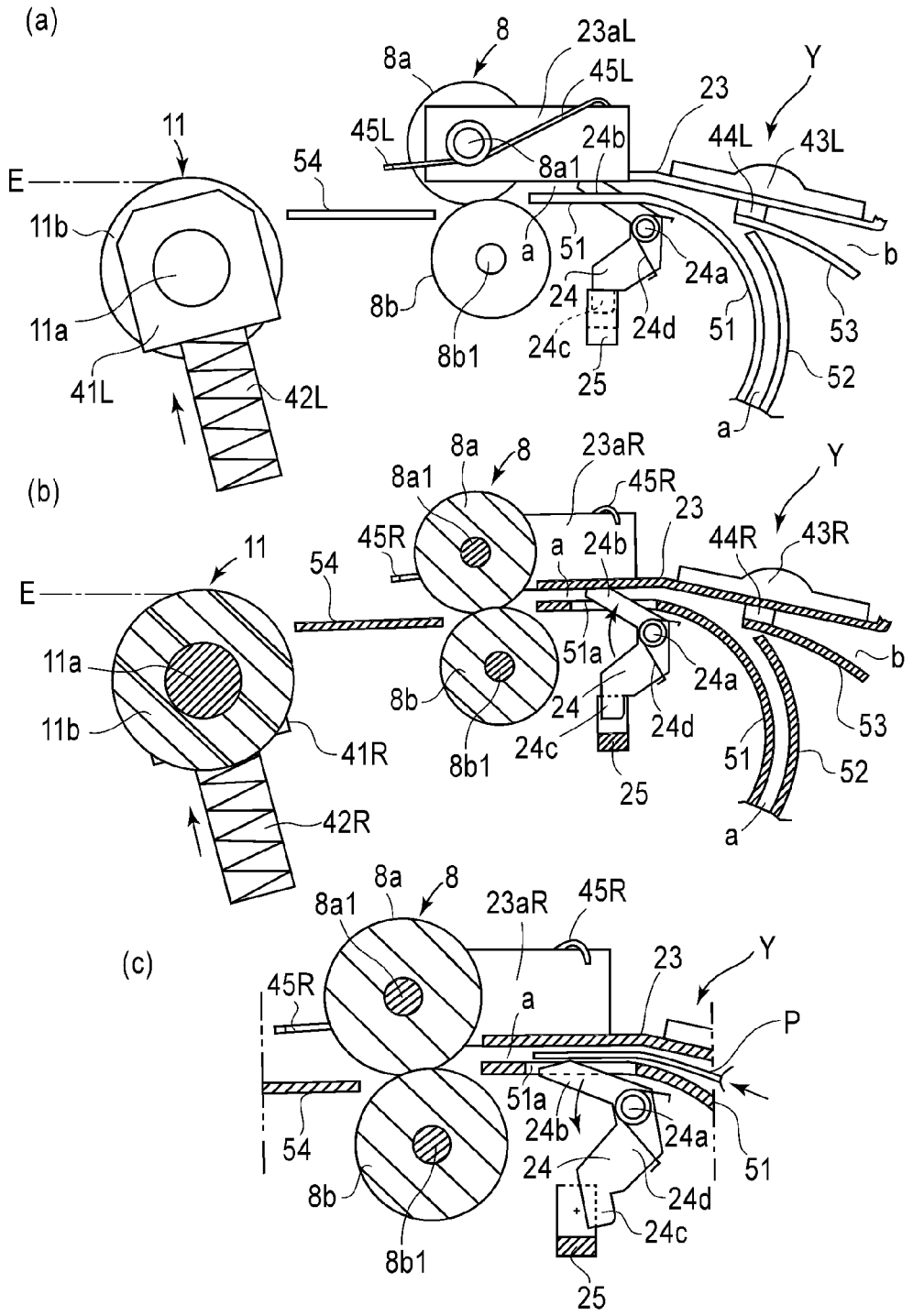
In FIG. 4, (*a*) to (*c*) are sectional views of the registration roller pair and the transfer roller shown in FIG. 3.

FIG. 3 is a perspective view of a portion including the registration roller pair 8 and the transfer roller 11 in the image forming apparatus 100. In FIG. 4, (*a*) is a longitudinal left side view of the portion, and (*b*) is a longitudinal right side view of the portion.

The registration roller pair 8 is a roller pair consisting of an upper roller 8*a* and a lower roller 8*b* which form the nip in contact to each other. Both the rollers 8*a* and 8*b* are provided and shaft-supported rotatably at left and right end portions of center shafts 8*a*1 and 8*b*1, respectively, by left and right side plates (not shown) of the apparatus main assembly 100A. The registration roller pair 8 is rotationally driven and stopped at the lower roller 8*b* in the recording material feeding direction at predetermined control timing by a driving device (not shown) controlled by the controller substrate 15*a*. The upper roller 8*a* is rotated by the rotation of the lower roller 8*b*, and the rotation thereof is stopped by stop of the rotation of the lower roller 8*b*.

The transfer roller 11 is an electroconductive elastic roller including a core metal 11*a* and an electroconductive elastic material layer 11*b* formed coaxially with the core metal 11*a* in a roller shape. The transfer roller 11 is disposed substantially in parallel to the registration roller pair 8 with a predetermined interval (spacing) in a downstream side of the registration roller pair 8 with respect to the feeding direction of the recording material P. The transfer roller 11 is provided and shaft-supported rotatably at left and right end portions of the core metal 11*a* by bearing members (transfer roller supporting members) 41L and 41R relative to left and right side plates (not shown) of the apparatus main assembly 100A.

The bearing members 41L and 41R are provided slidably (movably) in a vertical direction relative to the side plates, and are pushed up and urged by springs 42L and 42R. In a free state, the bearing members 41L and 41R are pushed up and moved to a predetermined upper-limit height position E defined by stoppers (not shown).

That is, the transfer roller 11 can be translated in the vertical direction between the left and right side plates of the apparatus main assembly 100A, and in a free state, is pushed up and moved to the predetermined upper-limit height position E by the springs 42L and 42R. Further, from the predetermined upper-limit height position E, the transfer roller 11 is movable downwardly against the urging force of the springs 42L and 42R.

When the cartridge 30 is in a state in which the cartridge 30 is mounted and positionally fixed at the image formable position of the cartridge mounting portion 100B as shown in FIGS. 7 and 8, the lower surface of the photosensitive drum 10 is pressed against the upper surface of the transfer roller 11 against the urging force of the springs 42L and 42R. For that reason, the transfer roller 11 moves from the predetermined upper-limit height position E downwardly while comprising the springs 42L and 42R.

As a result, the transfer roller 11 contacts the lower surface of the photosensitive drum 10 with a predetermined urging force (pressure) by compression reaction force of the springs 42L and 42R, and forms the transfer nip between itself and the photosensitive drum 10 (FIG. 14). In this state, the transfer roller 11 is rotated by the rotational drive of the photosensitive drum 10.

In FIGS. 3 and 4, a recording material feeding path a ranging from the feeding roller pair 7 to the registration roller pair 8 is constituted by a lower feeding guide plate 51 in the form so as to extend from below to above and then curve rearward and thus s as to extend substantially horizontally, a vertical feeding guide plate 52 opposing the lower feeding guide plate 51 in the front side, and an upper feeding guide plate 23.

Further, a recording material feeding path b which extends from a manual-bypass feeding roller 20 and which then merges with the recording material feeding path a is constituted by a front-rear feeding guide plate 52 in the front side and the above-described feeding guide plate 23.

Further, between the registration roller pair 8 and the transfer roller 11, a pre-transfer guiding plate 54 for guiding the lower surface of the recording material P fed from the registration roller pair 8 is provided. In a lower side of a guide plate portion of the lower feeding guide plate 51 extending substantially horizontally, the top sensor flag 24 and the photosensor 25 are disposed at a central portion with respect to a guiding plate widthwise direction (perpendicular to the recording material feeding direction).

The sensor 25 is provided and fixed to a stationary supporting member (not shown). The flag 24 is provided and supported swingably about a shaft portion 24*a* by a stationary supporting member (not shown). An upper arm portion 24*b* of the flag 24 enters the recording material feeding path a through a hole 51*a* provided in the lower feeding guide plate 51.

The flag 24 is rotated and urged by a helical torsion coil spring 24*d* in the clockwise direction indicated by an arrow in (*b*) of FIG. 4. By an urging force of the spring 24*d*, the flag 24 is held in a state in which the upper arm portion 24*b* contacts an inner surface of the feeding guide plate 23 and further movement thereof is limited. In this rotation attitude state of the flag 24, a lower arm portion 24*c* of the flag 24 is in a position where the lower arm portion 24*c* blocks an optical path of the sensor 25 (light-blocked state of the sensor 25 in (*a*) and (*b*) of FIG. 4).

When the recording material P is fed from the cassette 5 side, the manual-bypass tray 18 side or the feeding roller pair 17 side during an image forming operation of the image forming apparatus 100, in the recording material feeding path a, the upper arm portion 24*b* of the flag 24 is pushed down by a leading end of the recording material P in the front side of the registration roller pair 8. Then, as shown in (*c*) of FIG. 4, the flag 24 is rotated about the shaft portion 24*a* against the spring 24*d* in the counterclockwise direction indicated by an arrow, so that the lower arm portion 24*c* is moved to a position where the optical path of the sensor 25 is open (light-transmitted state of the sensor 25).

The controller substrate 15*a* controls the image writing timing on the photosensitive drum 10 on the basis of a signal for indicating that the state of the sensor 25 is changed from the light-blocked state to the light-transmitted state. When a trailing end passes through the position of the upper arm portion 24*b* of the flag 24, the flag 24 returns to the rotation attitude state shown in (*a*) and (*b*) of FIG. 4 by the urging force of the spring 24*d*.

On an upper surface of the feeding guide plate 23, at left and right portions in the front side (the guide plate 53 side, upstream side with respect to the recording material feeding direction), upward projected portions 43L and 43R are provided, respectively. Further, at left and right portions of the feeding guide plate 23 in the rear side (the registration roller pair 8 side, downstream side with respect to the recording material feeding direction), side plates 23*a*L and 23*a*R each provided with a shaft hole are provided, respectively.

In the shaft holes of the side plates 23*a*L and 23*a*R, left and right end portions of a center shaft 8*a*1 of the upper roller 8*a* of the registration roller pair 8 are engaged, respectively.

Figure 5:
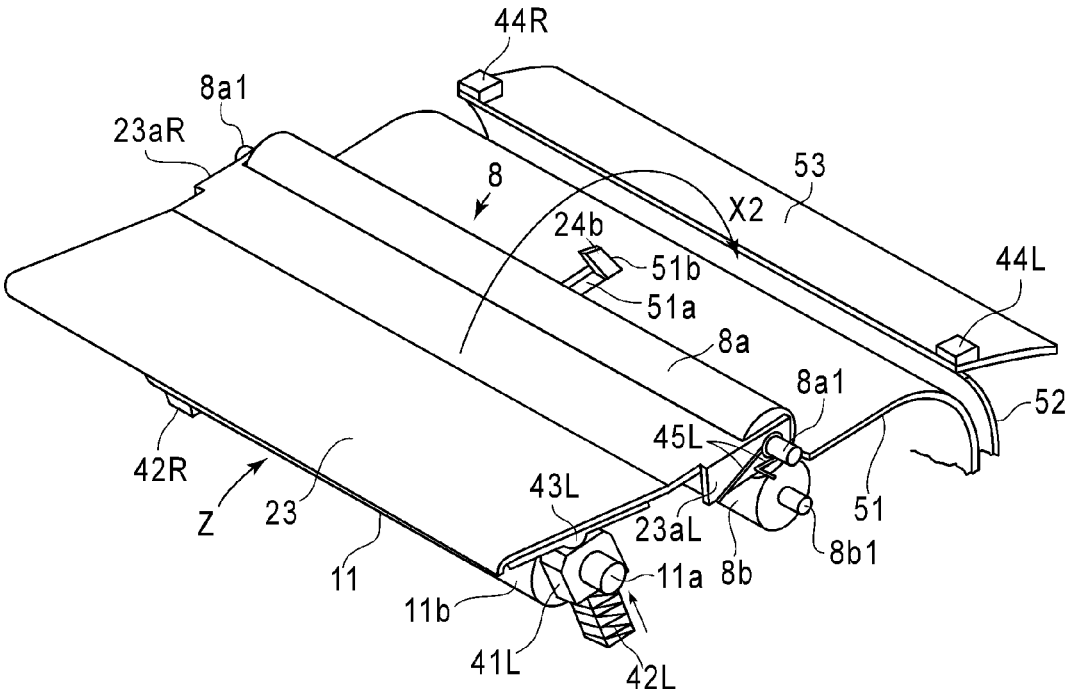
FIG. 5 is a perspective view showing a state in which the feeding guide plate located in a second position is moved to a first position.
Figure 6:
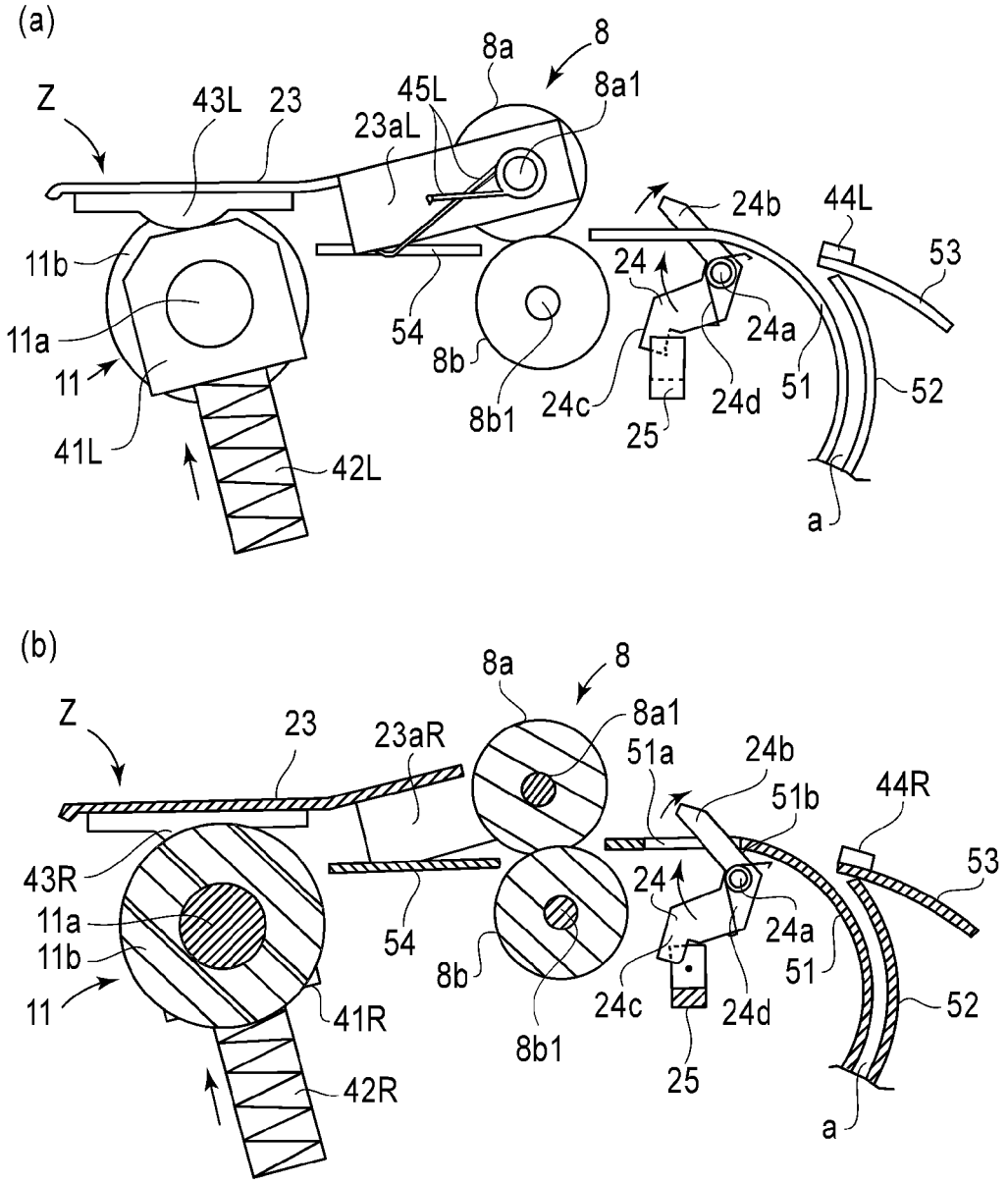
In FIG. 6, (*a*) and (*b*) are sectional views for illustrating the state shown in FIG. 3.

As a result, the feeding guide plate 23 is rotatable about the center shaft 8*a*1 of the upper roller 8*a*, and can be moved between a second position Y shown in FIGS. 3 and 4 and a first position Z shown in FIGS. 5 and 6 by being rotated. In this embodiment, the above-described feeding guide plate 23 is a movable guiding member for guiding the recording material P toward the downstream side with respect to the feeding direction of the recording material P.

At the second position Y, the feeding guide plate 23 opposes the upper sides of the lower feeding guide plate 51 and the front-rear feeding guide plate 53 in a predetermined manner in the downstream side of the registration roller pair 8 as shown in FIGS. 3 and 4. Further, the second position Y is a position where the recording material feeding paths a and b are formed by the feeding guide plates 51 and 53. In the second position Y, the feeding guide plate 23 is abutted against and received at an inner surface of each of front-side left and right portions thereof by stopper portions (projected spacer portions) 44L and 44R provided at left and right portions of an upper surface of the front rear feeding guide plate 53. That is, the feeding guide plate 23 is the guiding member for guiding the recording material P to the registration roller pair 8.

Further, the first position Z of the feeding guide plate 23 is a position where the feeding guide plate 23 located in the second position Y is rotated about the center shaft 8*a*1 in an arrow X1 direction in FIG. 3 while passing through an upper side of the upper roller 8*a*, and then reaches the transfer roller 11. Further, as shown in FIGS. 5 and 6, the first position Z is a position where the feeding guide plate 23 covers an upper surface of the transfer roller 11 in a state in which the feeding guide plate 23 is turned upside down. Further, in the first position Z of the feeding guide plate 23, a constitution in which a positional relationship such that the left and right projected portions 43L and 43R of the feeding guide plate 23 turned upside down are positioned correspondingly to top surfaces of the left and right bearing members 41L and 41R of the transfer roller 11 is established is employed.

Further, when the feeding guide plate 23 is moved from the second position Y to the first position Z, rotation regulation (limitation) of the flag 24 by the feeding guide plate 23 is eliminated. For that reason, the flag 24 is rotated about the shaft portion 24*a* by the urging force of the spring 24*d* in the clockwise direction indicated by an arrow in (*a*) and (*b*) of FIG. 6 by a predetermined angle of rotation defined by a stopper portion 51*b*. With this rotation, the lower arm portion 24*c* is moved to the position where the optical path of the sensor 25 is open (light-transmitted state of the sensor 25).

Further, when the feeding guide plate 23 located in the first position Z is rotated about the center shaft 8*a*1 in an arrow X2 direction and thus is returned to the second position Y, the flag 24 is pushed by the inner surface of the feeding guide plate 23 and thus is returned to the attitude of the angle of rotation as shown in (*a*) and (*b*) of FIG. 4. As a result, the lower arm portion 24*c* is moved to the position where the optical path of the sensor is blocked by the lower arm portion 24*c* (light-blocked state of the sensor 25).

In this embodiment, the feeding guide plate 23 is always rotated and urged about the center shaft 8*a*1 toward the second position Y side by the urging force of the helical torsion coil springs 45L and 45R. Accordingly, the feeding guide plate 23 is stably held in the second position Y in a free state as shown in FIGS. 3 and 4. The rotational movement of the feeding guide plate 23 from the second position Y to the first position Z is made against the rotational urging force of the springs 45L and 45R.

(Cartridge Packing)

Next, the form of the image forming apparatus in this embodiment during cartridge-packed transportation will be described specifically.

When the cartridge 30 is mounted in the apparatus main assembly 100A for the cartridge-packed transportation, i.e., when the cartridge 30 is inserted into the cartridge mounting portion 100B in a transportation state, the openable door (openable member) 27 is opened to an open position W as shown in FIG. 11. As a result, the cartridge mounting portion 100B of the apparatus main assembly 100A is opened largely.

The feeding guide plate 23 is located in the second position Y by the rotational urging force of the springs 45L and 45R. Therefore, the feeding guide plate 23 located in the second position Y is, as shown from (*a*) of FIG. 1 to (*b*) of FIG. 1, rotated and erected about the center shaft 8*a*1 in the arrow X1 direction against the urging force of the springs 45L and 45R with a user's hand or using an appropriate tool (jig).

Figure 1:
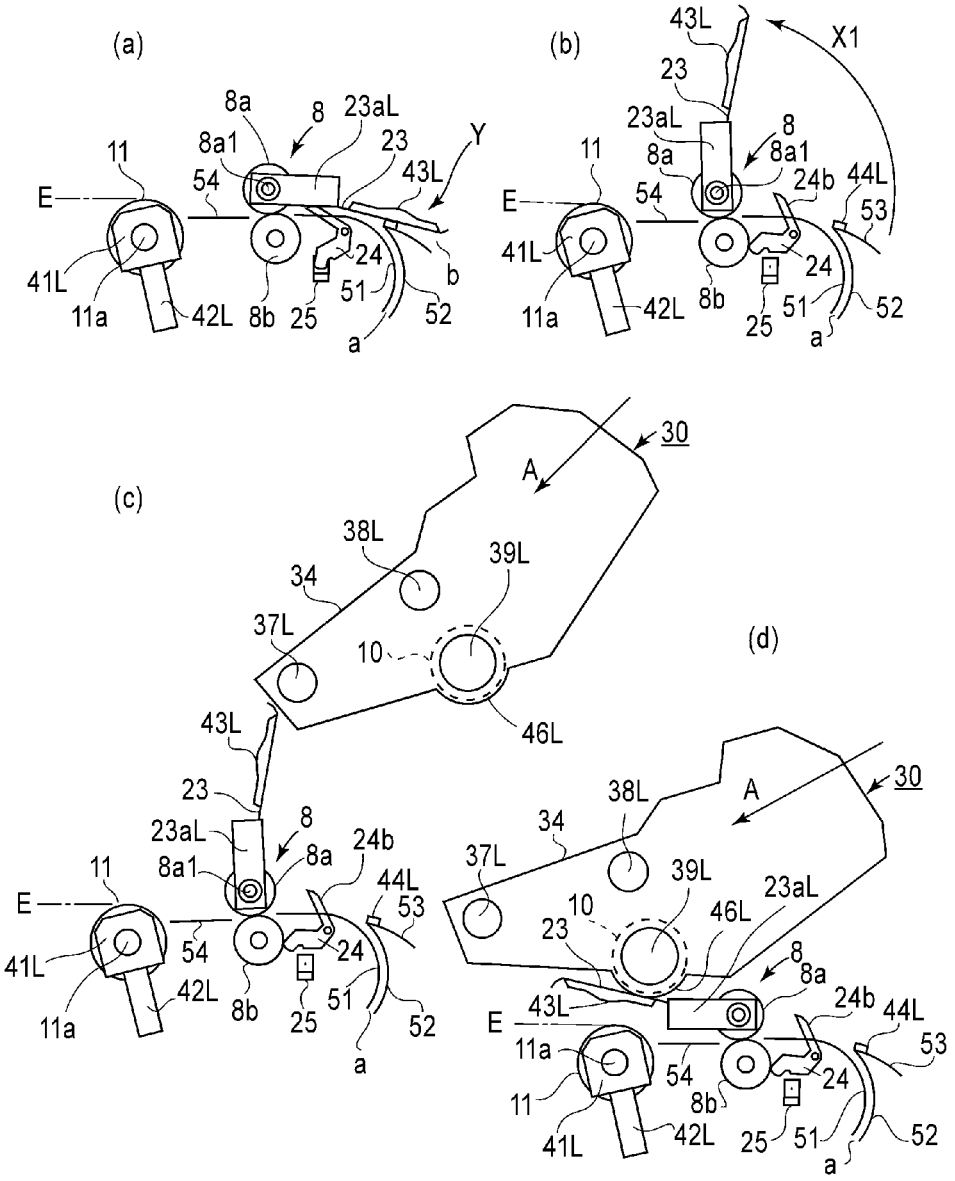
In FIG. 1, (*a*) to (*d*) are schematic views for illustrating motion of a feeding guide plate.

Then, in this state, the cartridge 30 to be packed and transported in the image forming apparatus 100 is inserted into the cartridge mounting portion 100B in the mounting manner described with reference to FIGS. 10 and 11. The feeding guide plate 23 erected as shown in (*b*) of FIG. 1 is received in contact with a free end of the cartridge frame 34 of the cartridge 30 in the insertion side as shown in (*c*) of FIG. 1. Accordingly, thereafter, an erected state of the feeding guide plate 23 is maintained even when the user moves the hand or the tool off the feeding guide plate 23.

By further inserting the cartridge 30, the feeding guide plate 23 is gradually rotated about the center shaft 8*a*1 toward the first position Z against the urging force of the springs 45L and 45R by being pushed by the inserted cartridge 30. In FIG. 1, (*d*) shows a state in which the feeding guide plate 23 is rotated to a position near the first position Z. In this state, the left and right downward projected portions 46L and 46R of the frame 34 of the cartridge 30 are positioned correspondingly to the left and right portions, respectively, of the rotated feeding guide plate 23 in the rear side, so that the feeding guide plate 23 and the cartridge 30 are contacted to each other.

When the cartridge 30 is further inserted and the cylindrical portions 39L and 39R abut against positioning portions as the terminal portions of the lower guide grooves 62L and 62R in the driving side and the non-driving side, respectively, the insertion of the cartridge 30 is completed. In FIG. 2, (*a*) shows an insertion completion state of the cartridge 30. In the cartridge insertion completion state, the feeding guide plate 23 is further pushed sufficiently downwardly by the left and right downward projected portions 46L and 46R of the frame 34 of the cartridge 30, and thus is in the state in which the feeding guide plate 23 is moved to the first position Z.

In this state, the left and right projected portions 43L and 43R which are directed downwardly by turning the feeding guide plate 23 upside down are positioned correspondingly to the top surfaces of the left and right bearing members 41L and 41R, respectively, of the transfer roller 11, and are contacted to the top surfaces of the left and right bearing members 41L and 41R. Then, the left and right bearing members 41L and 41R are moved downwardly by the urging force of the projected portions 43L and 43R against the urging force of the springs 42L and 42R, respectively, in a predetermined amount (distance). That is, the transfer roller 11 moves from the above-described upper-limit height position E toward below in the predetermined amount and thus is kept in the spaced state from the photosensitive drum 10 of the cartridge 30.

That is, the feeding guide plate 23 moves to the first position Z by being turned upside down and contacts the downward projected portions 46L and 46R provided on the frame 34 of the cartridge 30. Further, the downward projected portions 43L and 43R in the feeding guide plate 23 side contact the bearing members 41L and 41R of the transfer roller 11.

As described above, by the contact of the feeding guide plate 23 with the projected portions 46L and 46R provided on the frame 34 of the cartridge 30, so that as shown in (*b*) of FIG. 2, it is possible to provide a gap $\alpha$ between the photosensitive drum 10 and the feeding guide plate 23 with reliability. Further, by the contact of the projected portions 43L and 43R of the feeding guide plate 23 with the bearing members 41L and 41R of the transfer roller 11, it is possible to provide a gap $\beta$ between the feeding guide plate 23 and the transfer roller 11 with reliability.

By the contact of the projected portions 43L and 43R of the feeding guide plate 23 to the bearing members 41L and 41R of the transfer roller 11, the springs 42L and 42R is further compressed compared with the time when the transfer roller 11 contacts the photosensitive drum 10 (FIG. 14). As a result, as shown in (*b*) of FIG. 2, the transfer roller 11 is moved to a retracted position which is a position of a transportation form in which the transfer roller 11 does not contact the photosensitive drum 10 and the feeding guide plate 23.

Then, the openable door 27 is moved from the open position W to the closed position V, so that the opening 50 is closed. By this closing operation of the openable door 27, as described above, the urging mechanism performs the urging operation, so that the cartridge 30 is positionally fixed in the image formable position at the cartridge mounting portion 100B. Further, the drive output portion 70 performs the projection operation toward the cartridge mounting portion 100B side and thus is in a connected state with the driving force receiving portion 40 provided in the cartridge 30 side. Further, the electrical contact in the cartridge 30 side and the electrical contact in the apparatus main assembly side opening each other and thus establish electrical conduction therebetween. In this state, the image forming apparatus 100 is transported in the form in which the cartridge 30 is packed in the image forming apparatus 100.

As described above, in the image forming apparatus 100 in which the cartridge 30 is packed, the feeding guide plate 23 contacts the projected portions 46L and 46R provided on the frame 34 of the cartridge 30. Further, the projected portions 43L and 43R of the feeding guide plate 23 contact the bearing members 41L and 41R of the transfer roller 11. As a result, the transfer roller 11 is spaced from the photosensitive drum 10. Further, the feeding guide plate 23 does not contact the transfer roller 11 and the photosensitive drum 10. Accordingly, during the cartridge-packed transportation of the image forming apparatus 100, the recessed portion is not formed on the transfer roller 11, and the photosensitive drum 10 is not damaged.

Next, a procedure when the user first uses the image forming apparatus 100 in which the cartridge 30 is packed as described above will be described. The user opens the openable door 27 from the closed position V to the open position W, and thus largely opens (exposes) the opening 50 of the apparatus main assembly 100A. Further, as described above, by the interrelating mechanism interrelating with the opening operation of the openable door 27, the drive output portion 70 performs the retracting operation from the cartridge mounting portion 100B side, so that the connection thereof with the driving force receiving portion 40 provided in the cartridge 30 side is eliminated. Further, the positional fixing of the cartridge 30 to the apparatus main assembly 100A by the urging operation of the urging mechanism is eliminated.

As a result, the cartridge 30 is placed in a state in which the cartridge 30 packed in the image forming apparatus 100 is demountable to the outside of the image forming apparatus 100. Therefore, the user once takes out the packed cartridge 30 from the inside of the apparatus main assembly 100A.

In the case where the power to the image forming apparatus 100 is turned on while the packed cartridge 30 is not yet taken out, the feeding guide plate 23 in the first position Z, and therefore the sensor 25 is in the light-transmitted state as shown in FIG. 5. For that reason, into the controller substrate 15*a*, a signal indicating the light-transmitted state of the sensor 25 is inputted. On the basis of the inputted signal, the controller substrate 15*a* effects display, on a display panel 15*c*, of a message prompting the user to once take out the packed cartridge 30 from the apparatus main assembly 100A.

The feeding guide plate 23 located in the first position Z is (automatically) rotated and moved about the center shafts 8*a*1 and 8*b*1 by the urging force of the springs 45L and 45R from the first position Z toward the second position Y in the cartridge mounting portion 100B with the taking-out movement of the cartridge 30. That is, the feeding guide plate 23 automatically moves to the second position Y when the cartridge 30 is taken out from the cartridge mounting portion 100B. Also when the feeding guide plate 23 is rotated and moved from the first position Z toward the second position Y, the feeding guide plate 23 does not contact the transfer roller 11 and the photosensitive drum 10, and therefore does not damage the transfer roller 11 and the photosensitive drum 10.

Then, the feeding guide plate 23 is finally moved to and held at the second position Y where the feeding guide plate 23 is abutted against the stopper portions 44L and 44R as shown in FIG. 3 and (*a*) and (*b*) of FIG. 4. That is, the feeding guide plate 23 is moved to and held at the second position Y which is a position where the feeding paths a and b for guiding the recording material P, fed from the cassette 5 side, the manual-bypass tray 18 side, or the feeding roller pair 17 side, toward the registration roller pair 8 during the printing operation of the image forming apparatus are formed.

The feeding guide plate 23 is moved to and held at the second position Y, so that the rotation of the flag 24 is regulated (limited) by the feeding guide plate 23 as shown in (*a*) and (*b*) of FIG. 4, and the sensor 25 is in the light-blocked state. Thereafter, in the case where the power to the image forming apparatus 100 is turned on or has already been turned on, the signal indicating the light-blocked state of the sensor 25 is inputted into the controller substrate 15*a*. On the basis of the inputted signal, the controller substrate 15*a* detects that the feeding guide plate 23 exists at the second position Y.

That is, the sensor 25 detects the feeding guide plate 23 by the flag 24 in such a manner that a transportation state of the feeding guide plate 23 in the first position W is detected as a first detection state and that a state of the feeding guide plate 23 in the second position Y is detected as a second detection state.

Further, the transfer roller 11 is in a free state when the cartridge 30 is taken out and the feeding guide plate 23 moves from the first position Z to the second position Y. For that reason, the transfer roller 11 is pushed up and moved to the above-described upper-limit height position E (FIG. 3 and (*a*) and (*b*) of FIG. 4) by the urging force of the springs 42L and 42R.

The user pulls out and removes the toner seal member 32*f* ((*a*) of FIG. 12) from the new cartridge 30 taken out of the image forming apparatus 100, so that the communication opening 32*e* of the developing device 32 is unsealed (exposed). Further, when the photosensitive drum cover for protecting the exposed surface of the photosensitive drum 10 is mounted on the cartridge 30, the cover is removed. Then, the cartridge 30 is inserted again into the cartridge mounting portion 100B of the apparatus main assembly 100A. At this time, the feeding guide plate 23 is still kept in the second position Y, so that the cartridge 30 is inserted to the image formable position.

By this re-insertion of the cartridge 30, the lower surface of the photosensitive drum 10 in the cartridge 30 side contacts and urges the upper surface of the transfer roller 11, so that the transfer roller 11 moves downward from the predetermined upper-limit height position E against the urging force of the spring 41L and 41R. By the compression reaction force of the springs 41L and 41R with the downward movement, the upper surface of the transfer roller 11 is press-contacted to the lower surface of the photosensitive drum 10. As a result, the transfer nip is formed between the photosensitive drum 10 and the transfer roller 11 (FIG. 14).

Then, the opening 50 is closed by moving the openable door 27 from the open position W to the closed position V. The urging mechanism performs the urging operation by the interrelating mechanism interrelating with the closing operation of the openable door 27, so that the cartridge 30 is positionally fixed to the image formable position in the cartridge mounting portion 100B. Further, the drive output portion projects toward the cartridge mounting portion 100B side, and is in the connected state with the driving force receiving portion 40 provided in the cartridge 30 side. Further, the electrical contact in the cartridge 30 side and the electrical contact in the apparatus main assembly side contact each other and thus establish the electrical conduction. As a result, the image forming apparatus 100 is placed in an enable state of the image forming operation.

In this embodiment, the feeding guide plate 23 for guiding the recording material P toward the registration roller pair 8 during the printing operation of the image forming apparatus 100 is used as a member for spacing the transfer roller 11 from the photosensitive drum 10 during the cartridge-packed transportation. As a result, an exclusive part such as a spacing member is not needed, so that it becomes possible to space the photosensitive drum 10 and the transfer roller 11 from each other during the cartridge-packed transportation with a simple constitution.

Further, as described above, in this embodiment, by the top sensor flag 24 and the photo-sensor 25 which detect the leading edge of the recording material P to control the image writing timing, detection that the feeding guide plate 23 is in the first position Z is made. Further, by the top sensor flag 24 and the photo-sensor 25, detection that the cartridge 30 is a new one is made. As a result, the following is possible.

In the case where the first position Z and the new cartridge are detected, a message prompting the user to take out the cartridge 30 from the apparatus main assembly 100A is displayed on the display panel 15*c*. As a result, when the cartridge-packed image forming apparatus 100 is first used, the user can recognize that the packed-cartridge 30 should be once taken out from the apparatus main assembly 100A.

Then, the user takes out the packed-cartridge 30 from the apparatus main assembly 100A, whereby the feeding guide plate 23 is moved to the second position Y where the recording material P is guided toward the registration roller pair 8. Then, the image can be formed by inserting again the cartridge 30 after the toner seal member 32*f* is removed from the cartridge 30, and therefore the exclusive spacing member is not needed.

Further, a spacing member demounting operation and a switching member switching operation are not performed, so that the image forming apparatus can be simplified and thus it is possible to provide an image forming apparatus excellent in operativity.

Further, when the recording material P is jammed in the neighborhood of the registration roller pair 8, a grip portion (not shown) of the feeding guide plate 23 is raised and then the feeding guide plate 23 is rotated about the registration roller pair 8 against the springs 45L and 45R. As a result, the recording material feeding paths a and b upstream of the registration roller pair 8 with respect to the recording material feeding direction are opened (exposed), so that the jammed recording material can be cleared. That is, the feeding guide plate 23 is constituted so as to open the recording material feeding paths a and b.

Then, after the jam clearance, by moving the user's hand off the grip portion, the feeding guide plate 23 is returned to and held at the second position Y where the feeding guide plate 23 is contacted to and received by the stopper portions 44L and 44R by the urging force of the springs 45L and 45R.

Also in the case where the image forming apparatus 100 is not used for a long term after being used, the user can simply space the transfer roller 11 and the photosensitive drum 10 from each other by rotating the feeding guide plate 23 to the first position Z and then by inserting the cartridge 30 into the cartridge mounting portion 100B. As a result, the formation of the recessed portion due to the contact of the transfer roller 11 to the photosensitive drum 10 in a long-term rotation stop state can be prevented, so that image defect can be prevented.

An operation of the feeding guide plate 23 as the above-described characteristic guiding member is summarized as follows. The feeding guide plate 23 is movable to the first position W where the photosensitive drum 10 and the transfer roller 11 are spaced from each other when the cartridge 30 is inserted into the cartridge mounting portion 100B. Further, when the cartridge 30 is inserted into the cartridge mounting portion 100B, the feeding guide plate 23 is movable to the second position W where the photosensitive drum 10 and the transfer roller 11 are permitted to contact each other and the recording material P is guided toward the downstream side with respect to the recording material feeding direction.

The image forming apparatus 100 further includes the transfer roller supporting members 41L and 41R for supporting the transfer roller 11, and the feeding guide plate 23 spaces the transfer roller 11 from the photosensitive drum 10 by being contacted to the transfer roller supporting members 41L and 41R at the first position W. The feeding guide plate 23 automatically moves to the second position W when the cartridge 30 is taken out from the cartridge mounting portion 100B.

Embodiment 2

The means or mechanism for moving the feeding guide plate 23 also functioning as the spacing member from the second position Y to the first position W or from the first position W to the second position Y is not limited to the reverse rotation mechanism about the registration roller pair 8 as in Embodiment 1, but an arbitrary means or mechanism can be employed. In this embodiment, another means or mechanism is described. Constituent members or portions common to Embodiments 1 and 2 are represented by the same reference numerals or symbols and will be omitted from redundant description.

A constitution in this embodiment is effective in the case where a moving region of the feeding guide plate 23 in the apparatus main assembly when the feeding guide plate 23 is moved from the second position Y to the first position W or from the first position W to the second position Y. In this embodiment, the left and right projected portions 43L and 43R of the feeding guide plate 23 are provided downwardly at the left and right portions in an inner surface side of the feeding guide plate 23.

Figure 15:
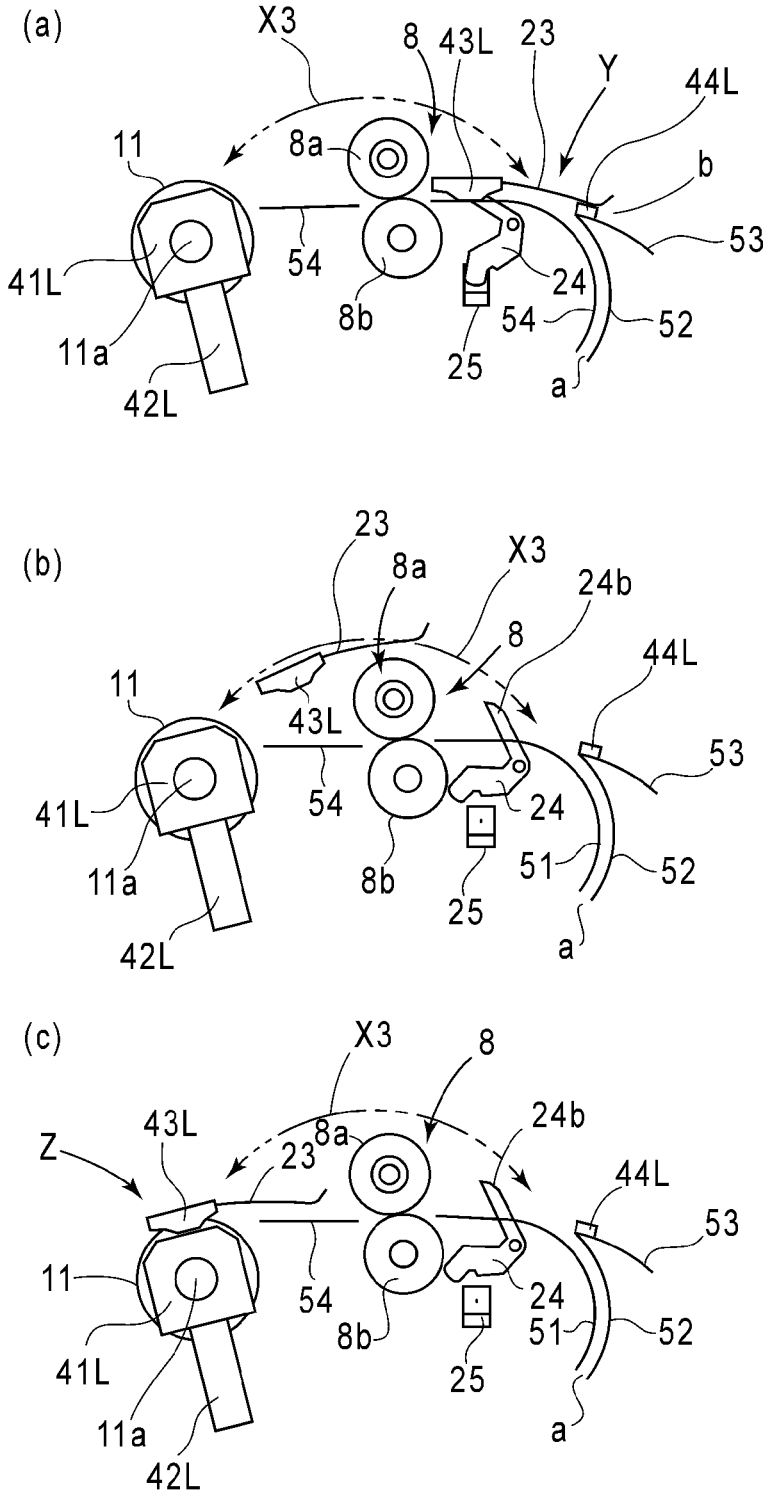
In FIG. 15, (*a*) to (*c*) are schematic views for illustrating motion of a feeding guide plate in Embodiment 2.
Figure 16:
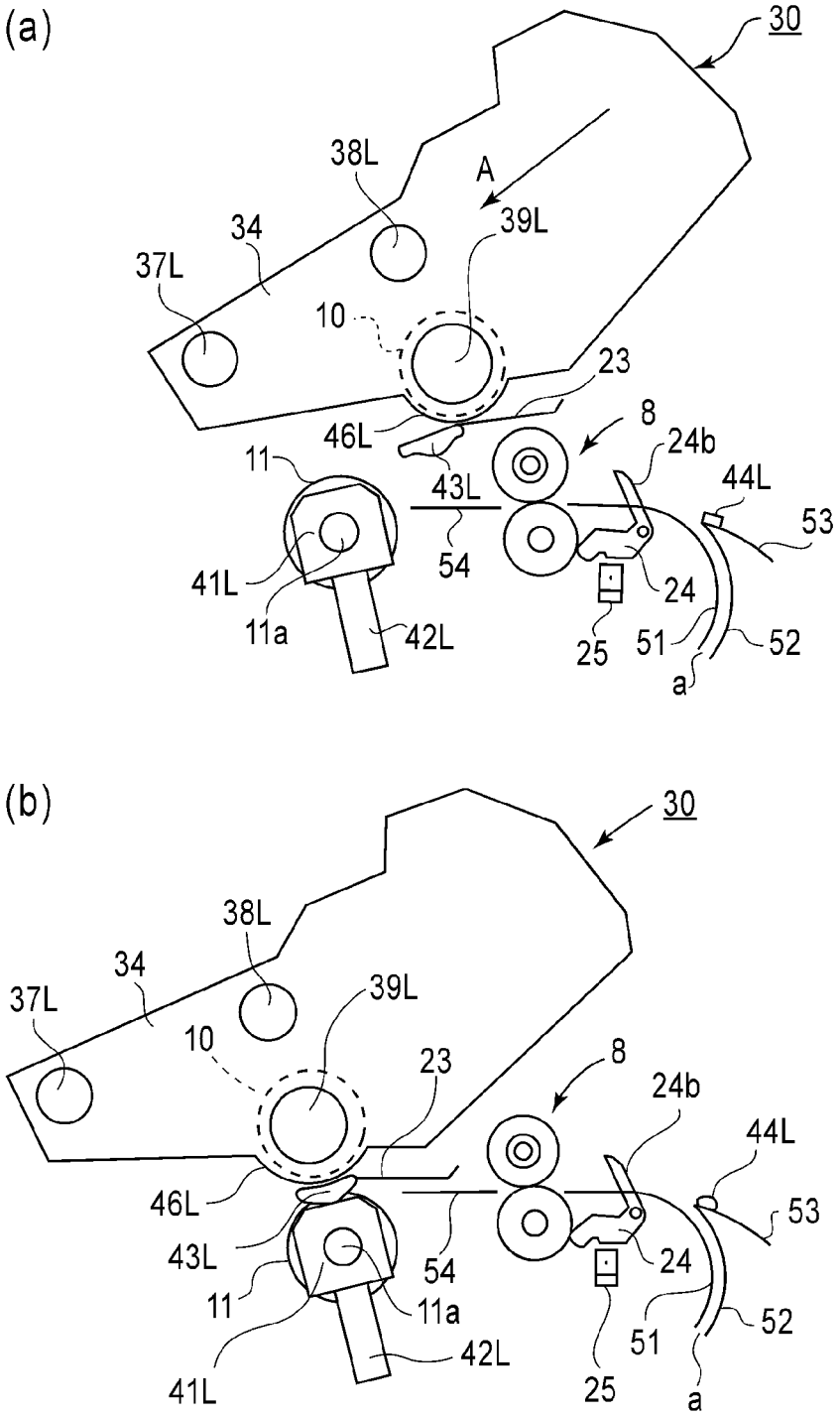
In FIG. 16, (*a*) and (*b*) are schematic views for illustrating motion of the feeding guide plate in Embodiment 2.

Further, the feeding guide plate 23 located in the second position Y as shown in (*a*) of FIG. 15 passes over the registration roller pair 8 as shown in (*b*) of FIG. 15, and then is slidable (movable) to the first position W without being turned upside down. X3 represents a slide movement locus of the feeding guide plate 23. Further, the feeding guide plate 32 located in the first position W as shown in (*c*) of FIG. 15 passes over the registration roller pair 8 as shown in (*b*) of FIG. 15, and then is slidable (movable) to the second position Y as shown in (*a*) of FIG. 15.

Although a specific means or mechanism for sliding (moving) the feeding guide plate 23 without turning the feeding guide plate 23 upside down described above is omitted from FIG. 15, it is possible to employ an appropriate means or mechanism. For example, it is possible to employ a mechanism constitution in which a guide rail or a guide groove is provided on each of the left and right side plates of the apparatus main assembly 100A and in which a slider (member-to-be-guided) to be guided by the rail or the groove is provided in the feeding guide plate 23 side. Further, it is also possible to employ a link mechanism constitution.

In this embodiment, the feeding guide plate 23 is always urged by an urging member in a direction of slide movement to the second position Y. Accordingly, in a free state, the feeding guide plate 23 is held at the second position Y where the feeding guide plate 23 is abutted against and stopped by the stopper portions 44L and 44R ((*a*) of FIG. 15). In this second position Y, similarly as in the case of the feeding guide plate 23 in Embodiment 1, the feeding guide plate 23 in this embodiment opposes the lower feeding guide plate 51 and the front-rear feeding guide plate 53 in a predetermined manner and thus forms the recording material feeding paths a and b.

Further, the feeding guide plate 23 held at the second position Y regulates (limits) the angle of rotation of the flag 24 similarly as in the case of the feeding guide plate 23 in Embodiment 1. As a result, the sensor 25 is placed in the light-blocked state.

The feeding guide plate 23 is slid (moved) from the second position Y toward the first position W, whereby similarly as in Embodiment 1, the regulation (limitation) of the angle of rotation of the flag 24 is eliminated and thus the sensor 25 is placed in the transmitted state ((*b*) and (*c*) of FIG. 15). Further, in a state in which the feeding guide plate 23 is slid (moved) to the first position W, a relational constitution in which the downward left and right projected portions 43L and 43R of the feeding guide plate 23 in the inner surface side of the feeding guide plate 23 are positioned correspondingly to the top surfaces of the left and right bearing members 41L and 41R of the transfer roller 11, respectively, is established.

When the cartridge 30 is mounted in the apparatus main assembly 100A for the cartridge-packed transportation, similarly as in Embodiment 1, the openable door 27 of the apparatus main assembly 100A is opened, so that the opening 50 is opened (exposed). The feeding guide plate 23 located in the second position Y is, as shown from (*a*) of FIG. 15 to (*b*) of FIG. 15, slid and moved toward above the registration roller pair 8 against the urging force of the urging member with the user's hand or using an appropriate tool (jig).

In this state, the cartridge 30 to be packed and transported in the image forming apparatus 100 is inserted into the cartridge mounting portion 100B in the mounting manner described with reference to FIGS. 10 and 11. Then, as shown in (*a*) of FIG. 15, the downward left and right projected portions 46L and 46R of the cartridge 30 contact the left and right portions of the upper surface of the feeding guide plate 23. Accordingly, thereafter, the slide movement state of the feeding guide plate 23 shown in (*b*) of FIG. 15 is maintained even when the user moves the hand or the tool off the feeding guide plate 23.

By further inserting the cartridge 30, the feeding guide plate 23 is gradually slid and moved toward the first position Z against the urging force by being pushed by the inserted cartridge 30.

When the cartridge 30 is further inserted and the cylindrical portions 39L and 39R abut against positioning portions as the terminal portions of the lower guide grooves 62L and 62R in the driving side and the non-driving side, respectively, the insertion of the cartridge 30 is completed similarly as in Embodiment 1. In this insertion completion state of the cartridge 30, the feeding guide plate 23 is further pushed sufficiently downwardly by the left and right downward projected portions 46L and 46R of the frame 34 of the cartridge 30, and thus is in the state in which the feeding guide plate 23 is moved to the first position Z. Then, the left and right bearing members 41L and 41R are moved downwardly by the urging force of the projected portions 43L and 43R against the urging force of the springs 42L and 42R, respectively, in a predetermined amount (distance).

That is, the transfer roller 11 moves from the above-described upper-limit height position E toward below in the predetermined amount and thus is kept in the spaced state from the photosensitive drum 10 of the cartridge 30. Thus, similarly as in Embodiment 1, the feeding guide plate 23 slid and moved to the first position Z contacts the downward projected portions 46L and 46R provided on the frame 34 of the cartridge 30. Further, the downward projected portions 43L and 43R in the feeding guide plate 23 side contact the bearing members 41L and 41R of the transfer roller 11.

By the contact of the feeding guide plate 23 with the projected portions 46L and 46R provided on the frame 34 of the cartridge 30, so that as shown in (*b*) of FIG. 2 similarly as in Embodiment 1, it is possible to provide a gap $\alpha$ between the photosensitive drum 10 and the feeding guide plate 23 with reliability. Further, by the contact of the projected portions 43L and 43R of the feeding guide plate 23 with the bearing members 41L and 41R of the transfer roller 11, it is possible to provide a gap $\beta$ between the feeding guide plate 23 and the transfer roller 11 with reliability.

Then, the openable door 27 is moved from the open position W to the closed position V, so that the opening 50 is closed. By this closing operation of the openable door 27, similarly as in Embodiment 1, the urging mechanism performs the urging operation, so that the cartridge 30 is positionally fixed in the image formable position at the cartridge mounting portion 100B. Further, the drive output portion 70 performs the projection operation toward the cartridge mounting portion 100B side and thus is in a connected state with the driving force receiving portion 40 provided in the cartridge 30 side. Further, the electrical contact in the cartridge 30 side and the electrical contact in the apparatus main assembly side open to each other and thus establish electrical conduction therebetween. In this state, the image forming apparatus 100 is transported in the form in which the cartridge 30 is packed in the image forming apparatus 100.

A procedure when the image forming apparatus 100 in which the cartridge 30 is packed as described above is first used is similar to that in Embodiment 1. In the case of Embodiment 2, with the taking-out movement of the cartridge 30, the feeding guide plate 23 is slid and moved from the first position W to the second position Y by the urging force of the urging member.

Also the image forming apparatus in this embodiment has a functional effect similar to that described in the image forming apparatus in Embodiment 1, and therefore the functional effect will be omitted from redundant description.

Other Embodiments (1) The image forming apparatus is not limited to the image forming apparatus of the electrophotographic type. The image forming apparatus may also be an image forming apparatus of an electrostatic recording type using an electrostatic recording dielectric member as the image bearing member, an image forming apparatus of a magnetic recording type using a magnetic recording (magnetic) member as the image bearing member, and the like image forming apparatus.

(2) The image forming apparatus may also be an image forming apparatus in which the transfer device is contacted to a recording material feeding member or an intermediary transfer member toward the image bearing member.

(3) The cartridge includes at least the image bearing member. The cartridge may be a process cartridge of a so-called integral type in which the image bearing member and at least the developing means as the image forming process means actable on the image bearing member are provided. The cartridge may also be a process cartridge of a so-called function separation type in which the image bearing member and at least one process means, other than the developing means, as the image forming process means actable on the image bearing member are provided.

The effect of the present invention is summarized as follows. According to the constitutions of the above-described embodiments, it is possible to simplify the image forming apparatus and it is possible to provide the image forming apparatus further excellent in operativity.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 027557/2014 filed Feb. 17, 2014, which is hereby incorporated by reference.

What is claimed is:

1. An image forming apparatus for forming an image on a recording material, wherein a cartridge including at least an image bearing member on which a toner image is to be formed is detachably mountable to a main assembly of said image forming apparatus, said image forming apparatus comprising:

a cartridge mounting portion for detachably mounting the cartridge;

a transfer device contactable to the image bearing member to form a nip where the toner image is transferred from the image bearing member onto the recording material;

a feeding mechanism for feeding the recording material to the nip; and a movable guiding member for guiding the recording material toward a downstream side with respect to a feeding direction of the recording material, wherein said guiding member is movable between a first position where the image bearing member and said transfer device are spaced from each other when the cartridge is in said cartridge mounting portion and a second position where when the cartridge is in said cartridge mounting portion, the image bearing member and said transfer device are permitted to contact each other and the recording material is guided toward the downstream side with respect to the feeding direction, and wherein when said guiding member is in the first position, said guiding member is positioned between said transfer device and the cartridge and covers said transfer device.

2. An image forming apparatus according to claim 1, further comprising a transfer device supporting member for supporting said transfer device, wherein said guiding member contacts said transfer device supporting member at the first position so as to space said transfer device from the image bearing member.

3. An image forming apparatus according to claim 2, wherein said transfer device supporting member moves and urges said transfer device in a direction of contacting the image bearing member.

4. An image forming apparatus according to claim 1, wherein when the cartridge is demounted from said cartridge mounting portion prior to initial use, said guiding member automatically moves to the second position.

5. An image forming apparatus according to claim 1, wherein said guiding member guides the recording material to said feeding mechanism.

6. An image forming apparatus according to claim 1, further comprising a detection flag rotatable in contact to said guiding member and a detecting sensor for detecting a position of said detection flag, wherein said detecting sensor detects the position of said detection flag so that a transport state where said guiding member is in the first position is detected as a first detection state by said detection flag and so that a state where said guiding member is in the second position is detected as a second detection state by said detection flag.

7. An image forming apparatus according to claim 6, wherein said detection flag and said detecting sensor detect a leading end of the recording material during a printing operation and control image writing timing.

8. An image forming apparatus according to claim 1, wherein said guiding member is constituted so that a recording material feeding path is openable.

9. An image forming apparatus according to claim 1, wherein the cartridge is a process cartridge including the image bearing member and an image forming process means actable on the image bearing member.

10. An image forming apparatus according to claim 1, wherein the image bearing member is a photosensitive drum.

* * * * *